US009994944B2

(12) United States Patent
Imataka et al.

(10) Patent No.: US 9,994,944 B2
(45) Date of Patent: Jun. 12, 2018

(54) STEEL FOR COLD FORGING/NITRIDING, STEEL MATERIAL FOR COLD FORGING/NITRIDING, AND COLD-FORGED/NITRIDED COMPONENT

(75) Inventors: Hideki Imataka, Kitakyushu (JP); Masayuki Horimoto, Nishinomiya (JP); Yusuke Usui, Kitakyushu (JP); Yuya Gyotoku, Utsunomiya (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 893 days.

(21) Appl. No.: 13/880,484

(22) PCT Filed: Oct. 19, 2011

(86) PCT No.: PCT/JP2011/074020

§ 371 (c)(1),
(2), (4) Date: Jun. 24, 2013

(87) PCT Pub. No.: WO2012/053541

PCT Pub. Date: Apr. 26, 2012

(65) Prior Publication Data

US 2013/0273393 A1 Oct. 17, 2013

(30) Foreign Application Priority Data

Oct. 20, 2010 (JP) ..... 2010-235231

(51) Int. Cl.
*C22C 38/52* (2006.01)
*C21D 7/02* (2006.01)
(Continued)

(52) U.S. Cl.
CPC ..... *C22C 38/52* (2013.01); *C21D 7/02* (2013.01); *C21D 9/32* (2013.01); *C22C 38/001* (2013.01);
(Continued)

(58) Field of Classification Search
CPC ..... C22C 38/04; C22C 38/06; C22C 38/24; C22C 38/18
See application file for complete search history.

(56) References Cited

U.S. PATENT DOCUMENTS 5,810,948 A * 9/1998 Nishiwaki ..... C22C 38/28 148/318
2010/0047106 A1* 2/2010 Saitoh ..... C21D 1/06 420/83
2015/0059933 A1* 3/2015 Imataka ..... C23C 8/50 148/318

FOREIGN PATENT DOCUMENTS

JP 54133418 A * 10/1979
JP 59159971 A * 9/1984
(Continued)

OTHER PUBLICATIONS

Machine translation of JP9071841A, Mar. 1997.*
(Continued)

*Primary Examiner* — Xiaowei Su
(74) *Attorney, Agent, or Firm* — Clark & Brody

(57) ABSTRACT

A steel for cold forging/nitriding has, by mass percent, C: 0.01 to 0.15%, Si≤0.35%, Mn: 0.10 to 0.90%, P≤0.030%, S≤0.030%, Cr: 0.50 to 2.0%, V: 0.10 to 0.50%, Al: 0.01 to 0.10%, N≤0.0080%, and O≤0.0030%, further according to need a specific amount of one or more elements selected from Mo, Cu, Ni, Ti, Nb, Zr, Pb, Ca, Bi, Te, Se and Sb, with the balance being Fe and impurities, and further satisfying the conditions of [399×C+26×Si+123×Mn+30×Cr+32×Mo+19×V≤160], [20≤(669.3×$\log_e$C−1959.6×$\log_e$N−6983.3)×(0.067×Mo+0.147×V)≤80], [140×Cr+125×Al+235×V≥160] and [90≤511×C+33×Mn+56×Cu+15×Ni+36×Cr+5×Mo+134×V≤170] are excellent in cold forgeability and machinability after cold forging.

6 Claims, 12 Drawing Sheets

(51) Int. Cl.

| | |
|---|---|
| ***C21D 9/32*** | (2006.01) |
| ***C22C 38/24*** | (2006.01) |
| ***C22C 38/60*** | (2006.01) |
| ***C23C 8/26*** | (2006.01) |
| ***C23C 8/32*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/40*** | (2006.01) |
| ***C22C 38/42*** | (2006.01) |
| ***C22C 38/20*** | (2006.01) |
| ***C22C 38/22*** | (2006.01) |
| ***C22C 38/26*** | (2006.01) |
| ***C22C 38/28*** | (2006.01) |
| ***C22C 38/46*** | (2006.01) |
| ***C22C 38/50*** | (2006.01) |

(52) U.S. Cl.

CPC ..... *C22C 38/002* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/40* (2013.01); *C22C 38/42* (2013.01); *C22C 38/46* (2013.01); *C22C 38/50* (2013.01); *C22C 38/60* (2013.01); *C23C 8/26* (2013.01); *C23C 8/32* (2013.01); *C21D 2211/005* (2013.01); *Y10T 428/12972* (2015.01)

(56) References Cited

FOREIGN PATENT DOCUMENTS

| | | | |
|---|---|---|---|
| JP | 05-171347 | | 7/1993 |
| JP | 05171347 | A * | 7/1993 |
| JP | 07-102343 | | 4/1995 |
| JP | 07-286257 | | 10/1995 |
| JP | 09-071841 | | 3/1997 |
| JP | 09-279295 | | 10/1997 |
| JP | 09279295 | A * | 10/1997 |
| JP | 10-306343 | | 11/1998 |
| JP | 11-124653 | | 5/1999 |
| JP | 2003231917 | A * | 8/2003 |
| JP | 2004-300473 | | 10/2004 |

OTHER PUBLICATIONS

Machine translation of JP10-306343, Nov. 1998.*
Machine translation of JP2003-231917A, Aug. 2003.*
Machine translation of JP09279295A, Oct. 1997.*
Machine translation of JP05171347A, Jul. 1993.*
English Abstract of JP59-159971 A, Sep. 1984.*
Machine translation of JP54-133418A, Oct. 1979.*
"Ultra-clean steels: steel grade characteristics and parts explosion of SP steel", Sanyo Technical Report, Japan, 2006, vol. 13, No. 1, pp. 77-78.

* cited by examiner

STEEL FOR COLD FORGING/NITRIDING, STEEL MATERIAL FOR COLD FORGING/NITRIDING, AND COLD-FORGED/NITRIDED COMPONENT

TECHNICAL FIELD

The present invention relates to a steel for cold forging/nitriding, a steel material for cold forging/nitriding, and a cold-forged/nitrided component. More particularly, the present invention relates to a steel for cold forging/nitriding and a steel material for cold forging/nitriding, which are excellent in cold forgeability and machinability after cold forging, and also can provide a component subjected to a cold forging and nitriding treatment with high core hardness and high surface hardness and a large effective case depth, and are used suitably as a starting material for a cold-forged/nitrided component, and a cold-forged/nitrided component using the same.

The "nitriding" in the present invention is a treatment including the "nitrocarburizing" treatment in which "N and C are caused to invade and diffuse", not merely the "nitriding" treatment in which "N is caused to invade and diffuse". Therefore, in the explanation below, a treatment including the "nitrocarburizing" is referred simply to as the "nitriding" in some cases.

In addition, the "cold forging/nitriding" means a treatment in which the "cold forging" has been carried out, and then the "nitriding" treatment is further carried out.

BACKGROUND ART

A component for machine structural use that is used for an automobile transmission and the like, such as a gear and a pulley for a belt-type continuously variable transmission (hereinafter, referred to as the "CVT"), is usually subjected to surface hardening treatments from the viewpoint of improving bending fatigue strength, pitting strength, and wear resistance. There are typical surface hardening treatments such as "carburizing and quenching", "induction quenching", and "nitriding".

Among the treatments mentioned above, the "carburizing and quenching" is a treatment in which a low carbon steel is generally used; and in the said treatment, C is caused to invade and diffuse in an austenitic region of a high temperature higher than the $Ac_3$ point, and thereafter quenching is carried out. The "carburizing and quenching" has an advantage of attaining a high surface hardness and a large effective case depth, but this treatment is accompanied by phase transformation; and thus in the said treatment, there is a problem that the heat treating distortion becomes large. Therefore, in the case where the high component accuracy is required, it is necessary to carry out a finish working, which is grinding, honing and so on, after the "carburizing and quenching". In addition, the "carburizing and quenching" has a problem that a so-called "abnormal carburized layer", which is a intergranularly oxidized layer, non-martensitic layer and so on, produced on the outer layer becomes a start point of failure such as bending fatigue failure, and the fatigue strength is deteriorated.

The "induction quenching" is a treatment in which a steel is rapidly heated to an austenitic region of a high temperature higher than the $Ac_3$ point and thereafter quenched. The "induction quenching" has an advantage that the effective case depth can be controlled with relative ease, but this treatment is not a surface hardening treatment in which C is caused to invade and diffuse like the carburizing treatment, and thus in the case of the "induction quenching" treatment, in order to attain necessary surface hardness, effective case depth and core hardness, a medium carbon steel, which has a higher C content as compared with a steel for carburizing treatment, is generally used. However, as for a starting material, the medium carbon steel has a higher hardness than the low carbon steel; and thus there is a problem that steels for the said "induction quenching" are inferior in machinability. In addition, with regard to the "induction quenching", a high frequency heating coil must be prepared for each component.

In contrast, the "nitriding" is a treatment in which N is caused to invade and diffuse at a temperature of about 400 to 550° C. not more than the $Ac_1$ point, and thereby a high surface hardness and a proper effective case depth are attained. In the case of the "nitriding", as compared with the "carburizing and quenching" and the "induction quenching", the treatment temperature is low; and therefore the said "nitriding" has an advantage that the heat treating distortion is small.

In addition, in the "nitriding", the "nitrocarburizing" is a treatment in which N and C are caused to invade and diffuse at a temperature of about 500 to 650° C. not more than the $Ac_1$ point, and thereby a high surface hardness is attained. This treatment is suitable for mass production because the treatment time is as short as several hours.

Furthermore, along with the trend toward the reduction in greenhouse gas with the recent restraint of global warming being a background, it has been demanded that a process in which a material treated is held at a high temperature, such as "hot forging" and "carburizing and quenching", be reduced. Therefore, the "nitriding" is a treatment responding to the demand of the day.

Unfortunately, the conventional steel for nitriding has problems described in the following <1> to <3>.

<1> The "nitriding" is a surface hardening treatment in which quenching from an austenitic region of a high temperature is not performed, that is to say, it is a surface hardening treatment in which strengthening accompanied by the martensitic transformation cannot be performed. Therefore, in order to provide a nitrided component with the desired core hardness, it is necessary to contain a large amount of alloying elements, and thus it is necessary to perform forming by hot forging or the like because it is difficult to perform forming by cold forging.

<2> As for a typical steel for nitriding, the "Aluminum Chromium Molybdenum Steel (SACM645)" specified in JIS G 4053 (2008) is available. With regard to the steel of this type, unfortunately, although a high surface hardness can be attained because Cr, Al and the like produce nitrides near the surface, a high bending fatigue strength cannot be attained because of a shallow effective case depth.

<3> In the nitrocarburizing of the nitriding, a component treated is held in a temperature range of about 500 to 650° C. for several hours; and thus the core of the said component is liable to be softened by tempering. As a result, for a component to which a high contact pressure is applied, plastic deformation is easily produced in the core, and the contact surface is depressed and deformed.

Accordingly, in order to solve the problems mentioned above, for example, the Patent Literatures 1 and 2 disclose techniques concerning the "nitriding".

The Patent Literature 1 discloses a "steel for nitrocarburizing excellent in cold forgeability" having an objective of providing a steel for nitrocarburizing that has a hardness after rolling of 200 or less in Vickers hardness, and is excellent in nitrocarburizing property and cold forgeability.

The aforementioned "steel for nitrocarburizing" consists, by mass percent, of C: 0.05 to 0.25%, Si: 0.05% or less, Mn: 0.55% or less, Cr: 0.50 to 2.00%; V: 0.02 to 0.35%, and Al: 0.005 to 0.050%, and further according to need Nb: 0.02 to 0.35%, with the balance being Fe and impurities.

The Patent Literature 2 discloses a "method for producing a nitrided component" by which a hard surface hardened layer, a large effective case depth, and the necessary core hardness can be obtained and in which the amount of machining such as cutting can be reduced. The aforementioned "method for producing a nitrided component" provides a technique in which a steel material having a chemical composition consisting, by mass percent, of C: 0.01 to 0.40%, Si: 0.10 to 0.70%, Mn: 0.20 to 1.50%, Cr: 0.50 to 2.50%, and V: 0.05 to 0.60%, and further according to need one or more of Al, Mo, Ti, Nb, Ta, B, S, Pb, Te, Se, Ca, Bi and Sb, with the balance being substantially Fe is subjected, before nitriding treatment, to heat treatment in which the precipitation of V is controlled, subsequently being subjected to a cold working, and is further subjected to a nitriding treatment.

LIST OF PRIOR ART DOCUMENT

Patent Literatures

Patent Literature 1: JP 5-171347 A
Patent Literature 2: JP 7-102343 A

DISCLOSURE OF THE INVENTION

Problems to be Solved by the Invention

The steel disclosed in the Patent Literature 1 is not necessarily excellent in all of cold forgeability, machinability after cold forging, deformation resistance, bending fatigue strength, and wear resistance. In addition, the effective case depth means a depth having a Vickers hardness (hereinafter, sometimes referred to as the "HV") of 400 or more, so that it cannot be said that the steel has a sufficient effective case depth.

The steel disclosed in the Patent Literature 2 contains a large amount of alloying elements. Therefore, if cold forging is carried out at a high working ratio, sufficient cold forgeability cannot necessarily be attained, which sometimes brings a problem.

The present invention has been made in view of the above-described situations, and accordingly the objectives thereof are to provide a steel for cold forging/nitriding and a steel material for cold forging/nitriding, which are excellent in cold forgeability and machinability after cold forging, and also can provide a component subjected to a cold forging and nitriding treatment with high core hardness and high surface hardness and a large effective case depth, and are used suitably as a starting material for a cold-forged/nitrided component.

In the concrete, the objectives of the present invention are to provide a steel for cold forging/nitriding and a steel material for cold forging/nitriding, which have a hardness before cold forging of 160 or less in HV, low cutting force after cold forging, and an excellent chip disposability, and further can attain the following hardness properties after cold forging and nitriding; the core hardness: 220 or more in HV, the surface hardness: 650 or more in HV, and the effective case depth: 0.20 mm or more; and thus can be used as a starting material for a cold-forged/nitrided component.

Another objective of the present invention is to provide a cold-forged/nitrided component using the said steel for cold forging/nitriding and steel material for cold forging/nitriding.

Means for Solving the Problems

As described before, the "nitriding" is a surface hardening treatment in which quenching from an austenitic region is not performed; that is to say, it is a surface hardening treatment in which strengthening accompanied by the martensitic transformation cannot be performed. Therefore, in order to provide a nitrided component with the desired core hardness, it is necessary to contain a large amount of alloying elements. However, in this case, it is difficult to perform forming by cold forging.

Accordingly, in order to solve the above problem, the present inventors first studied a means for attaining the core hardness, surface hardness, and effective case depth, which are necessary to a component for machine structural use, with forming by cold forging and performing surface hardening treatment by nitriding as a method for obtaining the component for machine structural use without holding a material treated at a high temperature as in the "hot forging" and "carburizing and quenching".

As a result, the present inventors arrived at a technical idea that if excellent cold forgeability can be attained by keeping the amount of alloying elements to a necessary minimum, and a high core hardness can be attained by a combined effect of a work hardening due to the cold forging and an age hardening at the nitriding temperature, both of the opposing properties of high core hardness and excellent cold forgeability can be achieved.

Consequently, based on the above-described technical idea, the present inventors further carried out experiments repeatedly, and obtained the following findings (a) to (e).

(a) If Cr and Al are contained in the steel, the surface hardness can be increased by nitriding.

(b) In order to attain a higher surface hardness by nitriding and to increase the amount of age hardening at the nitriding temperature, it is effective to contain V while the content of N in the steel is restricted. In addition, if Mo is contained, a larger amount of age hardening can be attained.

(c) On the other hand, if Cr and V are contained, cold forgeability is deteriorated. The restriction of the contents of individual component elements for ensuring cold forgeability without decreasing the core hardness has a limit. However, if the contents of C, Si, Mn, Cr, Mo and V are restricted to a specific range while the content of N is restricted, even if Cr and V are contained, excellent cold forgeability can be ensured. As a result, since cold forging can be carried out at a high working ratio, strengthening due to work hardening can be achieved.

(d) Furthermore, if the contents of C, Mn, Cu, Ni, Cr, Mo and V in the steel are restricted to a specific range, excellent machinability can be provided after cold forging.

(e) By the above work hardening and age hardening, a high core hardness necessary as a component for machine structural use can be attained.

The present invention has been accomplished on the basis of the above-described findings. The main points of the present invention are the steels for cold forging/nitriding shown in the following (1) to (5), the steel material for cold forging/nitriding shown in the following (6), and the cold-forged/nitrided component shown in the following (7).

(1) A steel for cold forging/nitriding, having a chemical composition comprising, by mass percent, C: 0.01 to 0.15%, Si: 0.35% or less, Mn: 0.10 to 0.90%, P: 0.030% or less, S: 0.030% or less, Cr: 0.50 to 2.0%, V: 0.10 to 0.50%, Al: 0.01 to 0.10%, N: 0.0080% or less, and O: 0.0030% or less, with the balance being Fe and impurities, and further the Fn1 expressed by the formula (1) is 160 or less, the Fn2 expressed by the formula (2) is 20 to 80, the Fn3 expressed by the formula (3) is 160 or more, and the Fn4 expressed by the formula (4) is 90 to 170;

$$Fn1=399\times C+26\times Si+123\times Mn+30\times Cr+32\times Mo+19\times V \quad (1),$$

$$Fn2=(669.3\times \log_e C-1959.6\times \log_e N-6983.3)\times(0.067\times Mo+0.147\times V) \quad (2),$$

$$Fn3=140\times Cr+125\times Al+235\times V \quad (3),$$

$$Fn4=511\times C+33\times Mn+56\times Cu+15\times Ni+36\times Cr+5\times Mo+134\times V \quad (4);$$

wherein each symbol C, Si, Mn, Cr, Mo, V, N, Al, Cu and Ni in the above formulas (1) to (4) represents the content by mass percent of the element concerned.

(2) The steel for cold forging/nitriding according to the above (1), which contains, by mass percent, Mo: 0.50% or less in lieu of a part of Fe.

(3) The steel for cold forging/nitriding according to the above (1) or (2), which contains, by mass percent, one or more elements selected from Cu: 0.50% or less and Ni; 0.50% or less in lieu of a part of Fe.

(4) The steel for cold forging/nitriding according to any one of the above (1) to (3), which contains, by mass percent, one or more elements selected from Ti: 0.20% or less, Nb: 0.10% or less, and Zr: 0.10% or less in lieu of a part of Fe.

(5) The steel for cold forging/nitriding according to any one of the above (1) to (4), which contains, by mass percent, one or more elements selected from Pb: 0.50% or less, Ca: 0.010% or less, Bi: 0.30% or less, Te: 0.30% or less, Se: 0.30% or less, and Sb: 0.30% or less in lieu of a part of Fe.

(6) A steel material for cold forging/nitriding having a chemical composition according to any one of the above (1) to (5), wherein the microstructure thereof is a ferritic-pearlitic structure, a ferritic-bainitic structure, or a ferritic-pearlitic-bainitic structure, and the area fraction of ferrite is 70% or more, and further the content of V in precipitates determined by the extraction residue analysis is 0.10% or less.

(7) A cold-forged/nitrided component having a chemical composition according to any one of the above (1) to (5), wherein the core hardness thereof is 220 or more in Vickers hardness, the surface hardness thereof is 650 or more in Vickers hardness, and the effective case depth thereof is 0.20 mm or more.

The term "impurities" so referred to in the phrase "the balance Fe and impurities" indicates those elements which come from the raw materials such as ore and scrap, and/or the production environment when the steel is produced on an industrial scale.

The "ferritic-pearlitic structure" indicates a composite microstructure of ferrite and pearlite, the "ferritic-bainitic structure" indicates a composite microstructure of ferrite and bainite, and the "ferritic-pearlitic-bainitic structure" indicates a composite microstructure of ferrite, pearlite, and bainite. The "area fraction of ferrite" does not include the area fraction of ferrite which constitutes pearlite together with cementite.

Advantageous Effects of the Invention

The steel for cold forging/nitriding and the steel material for cold forging/nitriding of the present invention are excellent in cold forgeability and machinability after cold forging, and also can provide a component subjected to a cold forging and nitriding treatment with high core hardness and high surface hardness and a large effective case depth. Therefore, the steel for cold forging/nitriding and the steel material for cold forging/nitriding of the present invention are used suitably as a starting material for a cold-forged/nitrided component.

In addition, the cold-forged/nitrided component of the present invention is excellent in deformation resistance, bending fatigue strength, and wear resistance; and therefore it can be used suitably as a component for machine structural use that is used for an automobile transmission and the like, such as a gear and a pulley for a CVT.

MODE FOR CARRYING OUT THE INVENTION

Figure 1:
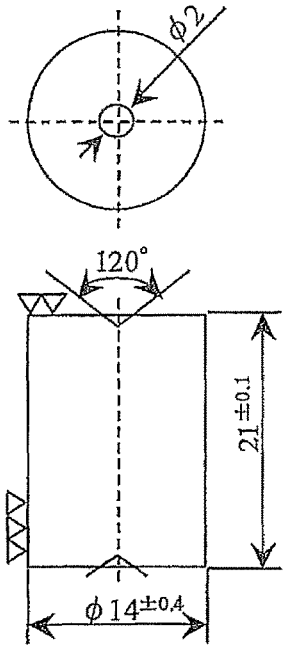
FIG. 1 is a view showing a shape of a smoothed test piece for measuring deformation resistance at the time of cold forging used in the EXAMPLES. In this figure, the units of the dimensions are "mm".

In the following, all of the requirements of the present invention are described in detail. In the following description, the symbol "%" for the content of each element means "% by mass".

(A) Chemical Composition:

C: 0.01 to 0.15%

C (carbon) is an essential element for ensuring the bending fatigue strength and core hardness of the cold-forged/nitrided component, and 0.01% or more of C must be contained. However, if the content of C is too large, the hardness increases, and thereby the cold forgeability deteriorates. Therefore, the upper limit of the C content is set; and the content of C is set to 0.01 to 0.15%. The content of C is preferably set to 0.03% or more, and 0.10% or less.

Si: 0.35% or less

Si (silicon) is an element contained as an impurity in the steel. On the other hand, Si is also an element having a deoxidizing action. When the content of Si is too large, the hardness increases; and thereby the cold forgeability deteriorates. Therefore, the upper limit of the Si content is set; and the content of Si is set to 0.35% or less. In order to accomplish the deoxidizing action, the content of Si is preferably set to 0.02% or more. The content of Si is more preferably set to 0.02% or more, and 0.15% or less.

Mn: 0.10 to 0.90%

Mn (manganese) has an action for ensuring the bending fatigue strength and core hardness of the cold-forged/nitrided component, and also has a deoxidizing action. In order to achieve these effects, 0.10% or more of Mn must be contained. However, if the content of Mn is too large, the hardness increases, and thereby the cold forgeability deteriorates. Therefore, the upper limit of the Mn content is set; and the content of Mn is set to 0.10 to 0.90%. The content of Mn is preferably set to 0.10% or more, and 0.70% or less.

P: 0.030% or less

P (phosphorous) is contained in the steel as an impurity. When the content of P is too large, P which segregated at the grain boundaries sometimes makes the steel brittle. Therefore, the upper limit of the P content is set; and the content of P is set to 0.030% or less. The more preferable P content is 0.020% or less.

S: 0.030% or less

S (sulfur) is contained in the steel as an impurity. On the other hand, if S is contained positively, S combines with Mn to form MnS, and therefore S has an effect of improving the machinability. However, if the content of S exceeds 0.030%, coarse MnS is formed, so that the hot workability and bending fatigue strength deteriorate. Therefore, the content of S is set to 0.030% or less. The content of S is preferably set to 0.015% or less. Incidentally, in the case where a machinability improving effect is achieved, the content of S is preferably set to 0.003% or more, and further preferably set to 0.005% or more.

Cr: 0.50 to 2.0%

Cr (chromium) combines with N at the time of nitriding to produces nitrides, and therefore Cr has effects of increasing the surface hardness in nitriding and of ensuring the bending fatigue strength and wear resistance of the cold-forged/nitrided component. However, if the content of Cr is less than 0.50%, the above-described effects cannot be achieved. On the other hand, if the content of Cr exceeds 2.0%, the steel becomes hard, and thus the cold forgeability deteriorates. Therefore, the content of Cr is set to 0.50 to 2.0%. The content of Cr is preferably set to 0.70% or more, and 1.5% or less.

V: 0.10 to 0.50%

V (vanadium) combines with C or/and N at the time of nitriding to form carbides, nitrides, and carbo-nitrides, and therefore V has an effect of increasing the surface hardness. In addition, V has an effect of increasing the core hardness by the age hardening action at a nitriding temperature, that is to say, by forming carbides. In order to achieve these effects, 0.10% or more of V must be contained. However, if the content of V is large, not only the hardness becomes too high, but also the cold forgeability deteriorates. Therefore, the upper limit of the V content is set; and the content of V is set to 0.10 to 0.50%. The content of V is preferably set to 0.15% or more, and 0.40% or less.

Al: 0.01 to 0.10%

Al (aluminum) has a deoxidizing action. In addition, Al combines with N at the time of nitriding to form AlN, and therefore Al has an effect of increasing the surface hardness. In order to achieve these effects, 0.01% or more of Al must be contained. However, if the content of Al is too large, not only hard and coarse $Al_2O_3$ is formed and therefore the cold forgeability deteriorates, but also there arises a problem that the effective case depth in nitriding becomes shallow and the bending fatigue strength and pitting strength deteriorate. Therefore, the upper limit of the Al content is set; and the content of Al is set to 0.01 to 0.10%. The content of Al is preferably set to 0.02% or more, and 0.07% or less.

N: 0.0080% or less

N (nitrogen) is contained in the steel as an impurity. Together with C, N combines with an element such as V to form carbo-nitrides. If the carbo-nitrides have precipitated at the time of hot rolling, the hardness becomes high, and the cold forgeability deteriorates. In addition, the effect of increasing the core hardness due to age hardening at a nitriding temperature cannot be achieved sufficiently. Therefore, the N content must be restricted; so that the content of N is set to 0.0080% or less. The preferable N content is 0.0070% or less.

O: 0.0030% or less

O (oxygen) is contained in the steel as an impurity. O forms oxide type inclusions and causes a fatigue failure with the inclusions, which become a starting point of the failure; and thus O degrades the bending fatigue strength. If the content of O exceeds 0.0030%, the bending fatigue strength deteriorates remarkably. Therefore, the content of O is set to 0.0030% or less. Incidentally, the preferable O content is 0.0020% or less.

Fn1: 160 or less

With regard to the steel for cold forging/nitriding and the steel material for cold forging/nitriding of the present invention, the Fn1 expressed by the following formula (1) must be 160 or less;

$$Fn1=399\times C+26\times Si+123\times Mn+30\times Cr+32\times Mo+19\times V \quad (1);$$

wherein each symbol C, Si, Mn, Cr, Mo and V represents the content by mass percent of the element concerned.

The above Fn1 is a parameter serving as an index of the cold forgeability. If the Fn1 is 160 or less, the hardness before cold forging becomes low, so that excellent cold forgeability can be attained. On the other hand, if the Fn1 exceeds 160, the hardness before cold forging becomes too high, so that the cold forgeability deteriorates. The Fn1 is preferably 80 or more, and 150 or less.

Fn2: 20 to 80

With regard to the steel for cold forging/nitriding and the steel material for cold forging/nitriding of the present invention, the Fn2 expressed by the following formula (2) must be 20 to 80;

$$Fn2=(669.3\times\log_e C-1959.6\times\log_e N-6983.3)\times(0.067\times Mo+0.147\times V) \quad (2);$$

wherein each symbol C, N, Mo and V represents the content by mass percent of the element concerned.

The above Fn2 is a parameter serving as an index of the amount of age hardening caused by nitriding after cold forging, that is to say, allowance of improvement in the core hardness caused by nitriding. When the Fn2 is 20 or more, the amount of age hardening after nitriding becomes large, and thereby the core hardness increases. However, if the Fn2 exceeds 80, the above-described effect is saturated. The Fn2 is preferably 30 or more, and 80 or less.

Fn3: 160 or more

With regard to the steel for cold forging/nitriding and the steel material for cold forging/nitriding of the present invention, the Fn3 expressed by the following formula (3) must be 160 or more;

$$Fn3=140\times Cr+125\times Al+235\times V \quad (3);$$

wherein each symbol Cr, Al and V represents the content by mass percent of the element concerned.

The above Fn3 is a parameter serving as an index of the surface hardness, bending fatigue strength, and wear resistance after nitriding.

All of Cr, Al and V produce hard nitrides and carbonitrides near the surface of the cold-forged/nitrided component during nitriding treatment, and thereby they can increase the surface hardness. By making the Fn3 160 or more, the surface hardness becomes 650 or more in HV, and the bending fatigue strength and wear resistance equivalent to those of a material performed the treatment of the "carburizing and quenching" are attained. In the case where the Fn3 is less than 160, the surface hardness is low, and the bending fatigue strength and wear resistance are poor as compared with the said material performed the treatment of the "carburizing and quenching". The Fn3 is preferably 170 or more, and 300 or less.

Fn4: 90 to 170

With regard to the steel for cold forging/nitriding and the steel material for cold forging/nitriding of the present invention, the Fn4 expressed by the following formula (4) must be 90 to 170;

$$Fn4=511\times C+33\times Mn+56\times Cu+15\times Ni+36\times Cr+5\times Mo+134\times V \quad (4);$$

wherein each symbol C, Mn, Cu, Ni, Cr, Mo and V represents the content by mass percent of the element concerned.

The Fn4 is a parameter serving as an index of the machinability after cold working.

If the Fn4 is 90 to 170, in turning after cold forging, the chip disposability is excellent, a low cutting force can be attained stably, and excellent machinability is provided. In the case where the Fn4 is less than 90, the chip produced by turning becomes long, and the chip disposability is poor. In addition, in the case where the Fn4 is more than 170, the cutting force in turning becomes high, which causes a deterioration in the tool life. The Fn4 is preferably 100 or more, and 160 or less.

One of the steels for cold forging/nitriding and the steel materials for cold forging/nitriding of the present invention has a chemical composition comprising elements mentioned above with the balance being Fe and impurities. Incidentally, as already described, the term "impurities" so referred to in the phrase "the balance Fe and impurities" indicates those elements which come from the raw materials such as ore and scrap, and/or the production environment when the steel is produced on an industrial scale.

Another of the steels for cold forging/nitriding and the steel materials for cold forging/nitriding of the present invention contains one or more elements selected from Mo, Cu, Ni, Ti, Nb, Zr, Pb, Ca, Bi, Te, Se and Sb in lieu of a part of Fe mentioned above.

Hereunder, the effects of containing Mo, Cu, Ni, Ti, Nb, Zr, Pb, Ca, Bi, Te, Se and Sb, which are optional elements, and the reasons for the restriction of content thereof are explained.

Mo: 0.50% or less

Mo (molybdenum) combines with C at a nitriding temperature to form carbides, and therefore Mo has an action for increasing the core hardness due to age hardening, so that Mo can be contained to achieve the above effect. However, if Mo is contained exceeding 0.50%, the hardness increases, and the cold forgeability deteriorates. Therefore, if Mo is contained, the content of Mo is set to 0.50% or less. Incidentally, when Mo is contained, the content of Mo is preferably 0.40% or less.

On the other hand, in the case where Mo is contained, in order to stably achieve the above-described effect of Mo, it is preferable that the content of Mo be 0.05% or more.

Both of Cu and Ni have an action for increasing the core hardness. Therefore, in order to achieve the above effect, these elements can be contained. In the following, the above-mentioned Cu and Ni will be explained.

Cu: 0.50% or less

Cu (copper) has an action for increasing the core hardness, and therefore, in order to achieve the above effect, Cu can be contained. However, if the content of Cu becomes large, the cold forgeability deteriorates, and additionally at high temperatures under hot rolling and so on, Cu fuses into a liquid. The liquefied Cu permeates into grain boundaries and makes the said grain boundaries brittle, and thus causes surface defects in hot rolling. Therefore, if Cu is contained, the upper limit of the Cu content is set; and the content of Cu is set to 0.50% or less. When Cu is contained, the content of Cu is preferably 0.40% or less.

On the other hand, in the case where Cu is contained, in order to stably achieve the above-described effect of Cu, it is preferable that the content of Cu be 0.10% or more.

Ni: 0.50% or less

Ni (nickel) has an action for increasing the core hardness, and therefore, in order to achieve the above effect, Ni can be contained. However, if the content of Ni becomes large, the cold forgeability deteriorates. Therefore, if Ni is contained, the upper limit of the Ni content is set; and the content of Ni is set to 0.50% or less. When Ni is contained, the content of Ni is preferably 0.40% or less.

On the other hand, in the case where Ni is contained, in order to stably achieve the above-described effect of Ni, it is preferable that the content of Ni be 0.10% or more.

With regard to the aforementioned Cu and Ni, only one or a combination of two elements can be contained. The total amount in the case where these elements are contained compositely can be 1.00% when both of the Cu content and the Ni content take the respective upper limit values: however, the said total amount is preferably 0.80% or less. In addition, in the case where Cu is contained, Ni is preferably contained compositely in order to avoid the occurrence of surface defects in hot rolling.

All of Ti, Nb and Zr have an action for improving the bending fatigue strength by making the grains fine. Therefore, in order to achieve the above effect, these elements can be contained. In the following, the aforementioned Ti, Nb and Zr will be explained.

Ti: 0.20% or less

Ti (titanium) combines with C or/and N to form fine carbides, nitrides, and carbo-nitrides which make the grains fine; and thus Ti has an action for improving the bending fatigue strength. Therefore, in order to achieve the above effect, Ti can be contained. However, in the case where the content of Ti is large, coarse TiN is produced, and thus the bending fatigue strength rather deteriorates. Therefore, if Ti is contained, the upper limit of the Ti content is set; and the content of Ti is set to 0.20% or less. When Ti is contained, the content of Ti is preferably 0.15% or less.

On the other hand, in the case where Ti is contained, in order to stably achieve the above-described effect of Ti, it is preferable that the content of Ti be 0.005% or more.

Nb: 0.10% or less

Nb (niobium) combines with C or/and N to form fine carbides, nitrides, and carbo-nitrides which make the grains fine; and thus Nb has an action for improving the bending fatigue strength. Therefore, in order to achieve the above effect, Nb can be contained. However, in the case where the content of Nb is large, the hardness increases, and the cold forgeability deteriorates. Therefore, if Nb is contained, the upper limit of the Nb content is set; and the content of Nb is set to 0.10% or less. When Nb is contained, the content of Nb is preferably 0.07% or less.

On the other hand, in the case where Nb is contained, in order to stably achieve the above-described effect of Nb, it is preferable that the content of Nb be 0.020% or more.

Zr: 0.10% or less

Zr (zirconium) also combines with C or/and N to form fine carbides, nitrides, and carbo-nitrides which make the grains fine; and thus Zr has an action for improving the bending fatigue strength. Therefore, in order to achieve the above effect, Zr can be contained. However, in the case where the content of Zr is large, the hardness increases, and the cold forgeability deteriorates. Therefore, if Zr is contained, the upper limit of the Zr content is set; and the content of Zr is set to 0.10% or less. When Zr is contained, the content of Zr is preferably 0.07% or less.

On the other hand, in the case where Zr is contained, in order to stably achieve the above-described effect of Zr, it is preferable that the content of Zr be 0.002% or more.

With regard to the aforementioned Ti, Nb and Zr, only one or a combination of two or more elements can be contained. The total amount in the case where these elements are contained compositely can be 0.40% when all of the contents of Ti, Nb and Zr take the respective upper limit values: however, the said total amount is preferably 0.24% or less.

All of Pb, Ca, Bi, Te, Se and Sb have an action for improving the machinability. Therefore, in order to achieve the above effect, these elements can be contained. In the following, the aforementioned Pb, Ca, Bi, Te, Se and Sb will be explained.

Pb: 0.50% or less

Pb (lead) has an action for improving the machinability. Therefore, in order to achieve the above effect, Pb can be contained. However, in the case where the content of Pb is large, the hot workability deteriorates, and in addition, the toughness of the cold-forged/nitrided component also deteriorates. Therefore, if Pb is contained, the upper limit of the Pb content is set; and the content of Pb is set to 0.50% or less. When Pb is contained, the content of Pb is preferably 0.20% or less.

On the other hand, in the case where Pb is contained, in order to stably achieve the above-described effect of Pb, it is preferable that the content of Pb be 0.02% or more.

Ca: 0.010% or less

Ca (calcium) has an action for improving the machinability. Therefore, in order to achieve the above effect, Ca can be contained. However, in the case where the content of Ca is large, the hot workability deteriorates, and in addition, the toughness of the cold-forged/nitrided component also deteriorates. Therefore, if Ca is contained, the upper limit of the Ca content is set; and the content of Ca is set to 0.010% or less. When Ca is contained, the content of Ca is preferably 0.005% or less.

On the other hand, in the case where Ca is contained, in order to stably achieve the above-described effect of Ca, it is preferable that the content of Ca be 0.0003% or more.

Bi: 0.30% or less

Bi (bismuth) also has an action for improving the machinability. Therefore, in order to achieve the above effect, Bi can be contained. However, in the case where the content of Bi is large, the hot workability deteriorates, and in addition, the toughness of the cold-forged/nitrided component also deteriorates. Therefore, if Bi is contained, the upper limit of the Bi content is set; and the content of Bi is set to 0.30% or less. When Bi is contained, the content of Bi is preferably 0.10% or less.

On the other hand, in the case where Bi is contained, in order to stably achieve the above-described effect of Bi, it is preferable that the content of Bi be 0.005% or more.

Te: 0.30% or less

Te (tellurium) has an action for improving the machinability. Therefore, in order to achieve the above effect, Te can be contained. However, in the case where the content of Te is large, the hot workability deteriorates, and in addition, the toughness of the cold-forged/nitrided component also deteriorates. Therefore, if Te is contained, the upper limit of the Te content is set; and the content of Te is set to 0.30% or less. When Te is contained, the content of Te is preferably 0.10% or less.

On the other hand, in the case where Te is contained, in order to stably achieve the above-described effect of Te, it is preferable that the content of Te be 0.003% or more.

Se: 0.30% or less

Se (selenium) also has an action for improving the machinability. Therefore, in order to achieve the above effect, Se can be contained. However, in the case where the content of Se is large, the hot workability deteriorates, and in addition, the toughness of the cold-forged/nitrided component also deteriorates. Therefore, if Se is contained, the upper limit of the Se content is set; and the content of Se is set to 0.30% or less. When Se is contained, the content of Se is preferably 0.15% or less.

On the other hand, in the case where Se is contained, in order to stably achieve the above-described effect of Se, it is preferable that the content of Se be 0.005% or more.

Sb: 0.30% or less

Sb (antimony) has an action for improving the machinability. Therefore, in order to achieve the above effect, Sb can be contained. However, in the case where the content of Sb is large, the hot workability deteriorates, and in addition, the toughness of the cold-forged/nitrided component also deteriorates. Therefore, if Sb is contained, the upper limit of the Sb content is set; and the content of Sb is set to 0.30% or less. When Sb is contained, the content of Sb is preferably 0.15% or less.

On the other hand, in the case where Sb is contained, in order to stably achieve the above-described effect of Sb, it is preferable that the content of Sb be 0.005% or more.

With regard to the aforementioned Pb, Ca, Bi, Te, Se and Sb, only one or a combination of two or more elements can be contained. The total amount in the case where these elements are contained compositely is preferably 0.50% or less, and more preferably 0.30% or less.

(B) Microstructure of Steel Material and the Content of V in Precipitates Determined by the Extraction Residue Analysis:

The steel material for cold forging/nitriding of the present invention is regulated so that in addition to having the chemical composition described in the above item (A), the microstructure thereof is a ferritic-pearlitic structure, a ferritic-bainitic structure, or a ferritic-pearlitic-bainitic structure, and the area fraction of ferrite is 70% or more, and further the content of V in precipitates determined by the extraction residue analysis is 0.10% or less.

With regard to the steel material for cold forging/nitriding, even if the microstructure thereof is a ferritic-pearlitic structure, a ferritic-bainitic structure, or a ferritic-pearlitic-bainitic structure, if the area fraction of ferrite having a low hardness becomes small, the deformation resistance at the time of cold forging is enhanced, and also cracks are liable to occur, and in particular, if the area fraction of ferrite becomes less than 70%, the cold forgeability deteriorates remarkably. Therefore, the area fraction of ferrite in the above-mentioned microstructures is set to 70% or more. The area fraction of ferrite in the said microstructures is more preferably 80% or more, and preferably 98% or less.

As already described, the "area fraction of ferrite" does not include the area fraction of ferrite which constitutes pearlite together with cementite.

With regard to the steel material for cold forging/nitriding, even if the microstructure thereof is a ferritic-pearlitic structure, a ferritic-bainitic structure, or a ferritic-pearlitic-bainitic structure, and the area fraction of ferrite is 70% or more, if fine V precipitates, that is to say, the carbides, nitrides and carbo-nitrides of V, do precipitate in a large amount, the ferrite is strengthened and the hardness is increased, so that the cold forgeability is liable to deteriorate. Therefore, in order to ensure the cold forgeability, it is preferable that the content of V in precipitates determined by the extraction residue analysis be 0.10% or less. The content of V in precipitates is more preferably 0.08% or less.

The content of V in precipitates determined by the extraction residue analysis can be determined as described below. For example, first, a proper test piece is cut off. Second, the cut-off test piece is subjected to a constant-current electrolysis in a 10% AA type solution. Third, the extracted solution is filtrated through a filter having a mesh size of 0.2 μm. Finally, the filtrated substance is subjected to a general chemical analysis. The 10% AA type solution is a solution in which tetramethylammoniumchloride, acetylacetone, and methanol are mixed in the ratio of 1:10:100.

As described above, in the case where the steel material is as-hot-rolled condition or as-hot-forged condition, the carbides, nitrides, and carbo-nitrides of V had precipitated, and thus in some cases, the cold forgeability is insufficient. Therefore, in order to obtain the steel material for cold forging/nitriding in which the microstructure thereof is a ferritic-pearlitic structure, a ferritic-bainitic structure, or a ferritic-pearlitic-bainitic structure, and the area fraction of ferrite is 70% or more, and further the content of V in precipitates determined by the extraction residue analysis is 0.10% or less, it is preferable that the steel material be "normalized"; in the concrete, the steel material be heated to a temperature of, for example, 850 to 950° C. after hot rolling or/and hot forging, and thereafter be cooled to room temperature by a forced air cooling.

After being carried out the heating treatment in the temperature range mentioned above, if the steel material is "normalized" by being cooled to room temperature with an atmospheric cooling or a slow cooling, the carbides, nitrides, and carbo-nitrides of V do precipitate again in the cooling process, so that the hardness increases and, in some cases, the cold forgeability deteriorates. Therefore, in order to prevent the carbides, nitrides, and carbo-nitrides of V from precipitating, after being heated, the steel material is preferably cooled by a forced air cooling such that the average cooling rate in the temperature range of, for example, 800 to 500° C. is 0.5 to 5.0° C./second.

(C) Cold-Forged/Nitrided Component:

The cold-forged/nitrided component of the present invention must be such that, in addition to having the chemical composition described in the above item (A), the core hardness thereof is 220 or more in HV, the surface hardness thereof is 650 or more in HV, and the effective case depth thereof is 0.20 mm or more.

In the case where the above conditions are met, the cold-forged/nitrided component is excellent in deformation resistance, bending fatigue strength, and wear resistance; and thus it can be used suitably as a component for machine structural use that is used for an automobile transmission and the like, such as a gear and a pulley for a CVT.

The core hardness is preferably 230 or more, and 350 or less in HV. The surface hardness is preferably 670 or more, and 900 or less in HV. The effective case depth is preferably 0.25 mm or more, and 0.50 mm or less.

(D) Method for Producing the Cold-Forged/Nitrided Component:

For example, in the case where the starting material has a cylindrical shape, the cold-forged/nitrided component described in the above item (C) can be manufactured by subjecting the steel material for cold forging/nitriding having the chemical composition described in the above item (A), preferably the steel material for cold forging/nitriding having the chemical composition described in the above item (A) and the microstructure and the content of V in precipitates determined by the extraction residue analysis described in the above item (B), to cold forging at a compression ratio of 50% or more, and thereafter by subjecting the steel material to nitriding at a temperature of 400 to 650° C. for 1 to 30 hours. The said compression ratio is a value expressed by the formula of "$\{(H_0-H)/H_0\}\times100$", when the height of starting material before cold forging is taken as $H_0$, and the height of the component after cold forging is taken as H.

In order to increase the core hardness of the said cold-forged/nitrided component, it is preferable to increase the working ratio, that is to say, the strain in cold forging, and to make the most of the strengthening due to work hardening.

After the said cold forging has been carried out, in order to make the most of the strengthening due to age hardening in addition to the said strengthening due to work hardening, it is preferable to carry out nitriding at a temperature of 400 to 650° C. for 1 to 30 hours.

In the case where the nitriding temperature is low and is less than 400° C., although a high surface hardness can be given to the said cold-forged/nitrided component, the effective case depth is shallow, and in addition, it is difficult to achieve the increase in core hardness due to age hardening. On the other hand, in the case where the nitriding temperature is high and exceeds 650° C., although the effective case depth is deep, the surface hardness decreases, and in addition, the core hardness also decreases. The nitriding temperature is preferably 450° C. or more, and 630° C. or less.

Although the nitriding time is changed depending on the effective case depth which is required for the cold-forged/nitrided component, in the case where the nitriding time is less than 1 hour, the effective case depth becomes shallow. On the other hand, in the case where the nitriding time is long and exceeds 30 hours, the cold-forged/nitrided component is unsuitable for mass production. The nitriding time is preferably 1 hour or more, and 20 hours or less.

The method of nitriding for obtaining the cold-forged/nitrided component of the present invention is not regulated especially, and gas nitriding, salt bath nitriding, ion nitriding and the like can be used. In nitrocarburizing, for example, an RX gas is used together with $NH_3$, and the treatment can be carried out in an atmosphere in which $NH_3$ and the RX gas are in the ratio of 1:1.

Although the nitriding time differs depending on the treatment temperature, for example, when nitrocarburizing is carried out at 590° C., nitriding time of 9 hours can provide the surface hardness, core hardness, and effective case depth described in the above item (C).

In addition, when it is desired to restrain the occurrence of brittle compounds, it is preferable to use fluorine gas as the pretreatment of nitriding due to $NH_3$, or to use mixed gas of $NH_3$ and $H_2$ as the gas for nitriding.

The following examples, which were carried out by gas nitrocarburizing, illustrate the present invention more specifically. These examples are, however, by no means limited the scope of the present invention.

EXAMPLES

The steels 1 to 22 having the chemical compositions shown in Table 1 were melted by using a 180 kg vacuum melting furnace and cast to ingots.

The steels 1 to 15 shown in Table 1 are steels of examples of the present invention (hereinafter, referred to as the "inventive examples") with chemical compositions being within the range regulated by the present invention, on the other hand, the steels 16 to 22 are steels of comparative examples with chemical compositions being out of the range regulated by the present invention.

Among the steels of comparative examples mentioned above, the steel 16 is a steel corresponding to the SCr420H specified in JIS G 4052 (2008).

TABLE 1

| | | Chemical composition (% by mass) Balance: Fe and impurities | | | | | | | | | | |
|---|---|---|---|---|---|---|---|---|---|---|---|---|
| Division | Steel | C | Si | Mn | P | S | Cu | Ni | Cr | Mo | Al | V |
| Inventive examples | 1 | 0.04 | 0.04 | 0.49 | 0.011 | 0.006 | — | — | 0.71 | — | 0.030 | 0.24 |
| | 2 | 0.03 | 0.04 | 0.49 | 0.010 | 0.006 | — | — | 1.30 | — | 0.032 | 0.25 |
| | 3 | 0.07 | 0.04 | 0.48 | 0.010 | 0.006 | — | — | 1.30 | 0.34 | 0.034 | 0.25 |
| | 4 | 0.07 | 0.04 | 0.50 | 0.010 | 0.006 | — | — | 1.00 | — | 0.029 | 0.15 |
| | 5 | 0.07 | 0.04 | 0.50 | 0.010 | 0.005 | — | — | 1.00 | — | 0.030 | 0.29 |
| | 6 | 0.07 | 0.04 | 0.52 | 0.010 | 0.008 | — | — | 1.00 | — | 0.032 | 0.35 |
| | 7 | 0.10 | 0.04 | 0.50 | 0.010 | 0.005 | — | — | 1.00 | — | 0.027 | 0.15 |
| | 8 | 0.09 | 0.04 | 0.51 | 0.010 | 0.010 | — | — | 1.00 | — | 0.030 | 0.30 |
| | 9 | 0.07 | 0.04 | 0.50 | 0.010 | 0.008 | — | — | 1.00 | — | 0.035 | 0.37 |
| | 10 | 0.07 | 0.04 | 0.53 | 0.010 | 0.004 | — | — | 0.70 | — | 0.039 | 0.30 |
| | 11 | 0.09 | 0.05 | 0.53 | 0.009 | 0.006 | — | 0.20 | 1.25 | — | 0.025 | 0.25 |
| | 12 | 0.07 | 0.04 | 0.50 | 0.010 | 0.005 | 0.12 | 0.17 | 1.30 | — | 0.024 | 0.30 |
| | 13 | 0.09 | 0.04 | 0.55 | 0.010 | 0.005 | — | — | 1.30 | — | 0.029 | 0.30 |
| | 14 | 0.08 | 0.07 | 0.64 | 0.012 | 0.007 | — | — | 1.25 | — | 0.032 | 0.20 |
| | 15 | 0.09 | 0.06 | 0.65 | 0.010 | 0.008 | — | — | 1.28 | — | 0.033 | 0.21 |
| Comparative examples | 16 | * 0.20 | 0.20 | 0.83 | 0.016 | 0.021 | — | — | 0.87 | — | 0.015 | * — |
| | 17 | 0.11 | 0.07 | 0.75 | 0.014 | 0.010 | — | — | 1.15 | — | 0.022 | 0.30 |
| | 18 | 0.05 | 0.07 | 0.58 | 0.013 | 0.008 | — | — | 0.95 | — | 0.078 | 0.10 |
| | 19 | 0.10 | 0.07 | 0.60 | 0.012 | 0.007 | — | — | 0.52 | 0.28 | 0.028 | 0.11 |
| | 20 | 0.09 | 0.08 | 0.55 | 0.009 | 0.003 | — | — | 0.75 | 0.12 | 0.033 | * 0.55 |
| | 21 | 0.04 | 0.05 | 0.25 | 0.008 | 0.004 | — | — | 0.70 | 0.06 | 0.050 | 0.24 |
| | 22 | 0.07 | 0.15 | 0.45 | 0.010 | 0.005 | — | — | 1.20 | — | 0.093 | * 0.59 |

TABLE 1-continued

| Division | Steel | Chemical composition (% by mass) Balance: Fe and impurities | | | | | | |
|---|---|---|---|---|---|---|---|---|
| | | N | O | Others | Fn1 | Fn2 | Fn3 | Fn4 |
| Inventive examples | 1 | 0.0060 | 0.0015 | — | 103 | 31 | 160 | 94 |
| | 2 | 0.0059 | 0.0012 | — | 116 | 25 | 245 | 111 |
| | 3 | 0.0070 | 0.0010 | — | 141 | 55 | 245 | 132 |
| | 4 | 0.0058 | 0.0010 | — | 123 | 29 | 179 | 108 |
| | 5 | 0.0045 | 0.0021 | — | 126 | 78 | 212 | 127 |
| | 6 | 0.0053 | 0.0011 | — | 130 | 77 | 226 | 136 |
| | 7 | 0.0049 | 0.0018 | — | 135 | 42 | 179 | 124 |
| | 8 | 0.0050 | 0.0008 | Pb: 0.07, Ca: 0.0015 | 135 | 79 | 214 | 139 |
| | 9 | 0.0054 | 0.0010 | Se: 0.12, Sb: 0.11 | 128 | 80 | 231 | 138 |
| | 10 | 0.0049 | 0.0012 | Ti: 0.12 | 121 | 73 | 173 | 119 |
| | 11 | 0.0065 | 0.0011 | — | 145 | 47 | 237 | 145 |
| | 12 | 0.0050 | 0.0011 | Zr: 0.051, Te: 0.0025 | 135 | 71 | 256 | 149 |
| | 13 | 0.0053 | 0.0012 | Nb: 0.035, Bi: 0.050 | 149 | 74 | 256 | 151 |
| | 14 | 0.0064 | 0.0010 | — | 154 | 36 | 226 | 134 |
| | 15 | 0.0060 | 0.0012 | — | 160 | 44 | 233 | 142 |
| Comparative examples | 16 | * 0.0160 | 0.0013 | — | * 213 | * 0 | * 124 | 161 |
| | 17 | 0.0068 | 0.0018 | — | * 178 | 58 | 234 | 163 |
| | 18 | 0.0070 | 0.0025 | — | 124 | * 11 | 166 | 92 |
| | 19 | 0.0059 | 0.0022 | — | 142 | 54 | * 102 | 106 |
| | 20 | 0.0055 | 0.0010 | — | 142 | * 142 | 238 | 165 |
| | 21 | 0.0050 | 0.0015 | — | 75 | 49 | 161 | * 86 |
| | 22 | 0.0075 | 0.0010 | — | 134 | 72 | 318 | * 173 |

$Fn1 = 399 \times C + 26 \times Si + 123 \times Mn + 30 \times Cr + 32 \times Mo + 19 \times V$ $Fn2 = (669.3 \times \log_e C - 1959.6 \times \log_e N - 6983.3) \times (0.067 \times Mo + 0.147 \times V)$ $Fn3 = 140 \times Cr + 125 \times Al + 235 \times V$ $Fn4 = 511 \times C + 33 \times Mn + 56 \times Cu + 15 \times Ni + 36 \times Cr + 5 \times Mo + 134 \times V$ The mark * indicates falling outside the conditions regulated by the present invention.

Each ingot was subjected to the homogenizing treatment by being held at 1250° C. for 5 hours, and thereafter was hot forged to prepare both a steel bar having a diameter of 35 mm and a length of 1000 mm and a steel bar having a diameter of 45 mm and a length of 1000 mm.

Among the steel bars mentioned above, the steel bars of the steels 1 to 15 and 17 to 22 were "normalized" by being held at 950° C. for 1 hour and thereafter by being cooled to room temperature by a forced air cooling. As a result of measurement made by inserting a thermocouple in the steel bar, it was revealed that the average cooling rate in the temperature range of 800 to 500° C. of each forced air cooling was 1.51° C./second in the R/2 portion ("R" represents a radius of the steel bar) of the bar having the diameter of 35 mm, and 0.82° C./second in the R/2 portion of the steel bar having the diameter of 45 mm.

On the other hand, the steel bars of the steel 16 containing no V were "normalized" by being held at 920° C. for 1 hour and thereafter by being cooled to room temperature by an atmospheric cooling.

With regard to each of the steels, various types of test pieces were cut off from a part of the thus normalized steel bar having the diameter of 35 mm.

In the concrete, with regard to each of the steels, the said normalized steel bar having the diameter of 35 mm was "cut transversely", that is to say, was cut perpendicularly to the axial direction (the longitudinal direction). Next, the cut steel bar was embedded in a resin so that the cut plane did be the test plane. Thereafter the above embedded steel bar was mirror-like finished in order to prepare a test piece for measurement of Vickers hardness as-normalized condition (that is to say, before cold working) and for observation of microstructure.

In addition, with regard to each of the steels, a specimen measuring 10 mm×10 mm×10 mm was cut off from the R/2 portion of the said normalized steel bar having the diameter of 35 mm, in order to carry out the extraction residue analysis.

Furthermore, with regard to each of the steels, as test pieces for measuring deformation resistance at the time of cold forging, 6 smoothed test pieces shown in FIG. 1 were cut off from the central portion of the said normalized steel bar having the diameter of 35 mm in parallel to the axial direction thereof. Similarly, as test pieces for measuring critical compression ratio at the time of cold forging, 5 notched test pieces shown in FIG. 2 were cut off from the central portion of the said normalized steel bar having the diameter of 35 mm in parallel to the axial direction thereof.

With regard to each of the steels, both the remainder of the normalized steel bar having the diameter of 35 mm and the normalized steel bar having the diameter of 45 mm were peeled, and thereafter they were subjected to a strain by cold drawing in place of cold forging, and the properties after cold forging were evaluated by the properties after the drawing.

That is to say, the remainder of the normalized steel bar having the diameter of 35 mm was peeled to a diameter of 28 mm, being subjected to a pickling and lubricating treatment, and thereafter the said steel bar was carried out the cold drawing so that the diameter became 15.45 mm.

The diameters of dies used for the above drawing were 26.5 mm, 23.5 mm, 21.5 mm, 19.95 mm, 18.17 mm and 15.45 mm in that order. Incidentally, the total reduction of area at the time when drawing was carried out from 28 mm to 15.45 mm in diameter was 70%.

With regard to each of the steels, the thus obtained cold drawn material having the diameter of 15.45 mm was cut transversely. Next, the cut material was embedded in a resin so that the cut plane did be the test plane. Thereafter the above embedded material was mirror-like finished, in order to prepare a test piece for measurement of Vickers hardness after drawing (that is to say, after cold working).

Figure 3:
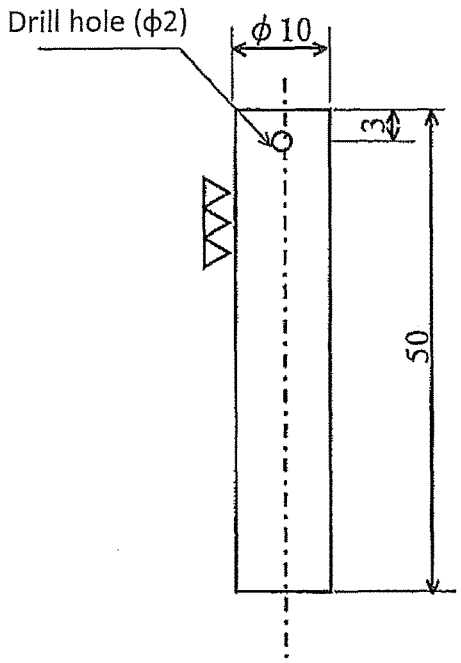
FIG. 3 is a view showing a shape of a round bar test piece for measuring hardness and so on after nitriding used in the EXAMPLES. In this figure, the units of the dimensions are "mm".

Furthermore, with regard to each of the steels, in order to measure the hardness and so on after nitriding, a round bar test piece having a diameter of 10 mm shown in FIG. 3 was cut off from the central portion of the said cold drawn material having the diameter of 15.45 mm in parallel to the axial direction thereof. In addition, notched Ono type rotating bending fatigue test pieces having the rough shape shown in FIG. 4 were cut off.

Figure 5:
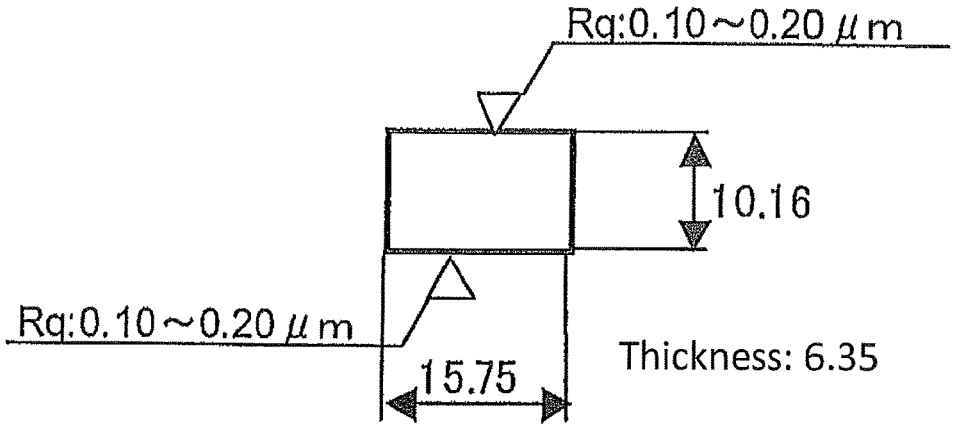
FIG. 5 is a view showing a shape of a block test piece A for investigating wear resistance used in the EXAMPLES. In this figure, the units of the dimensions are "mm".
Figure 6:
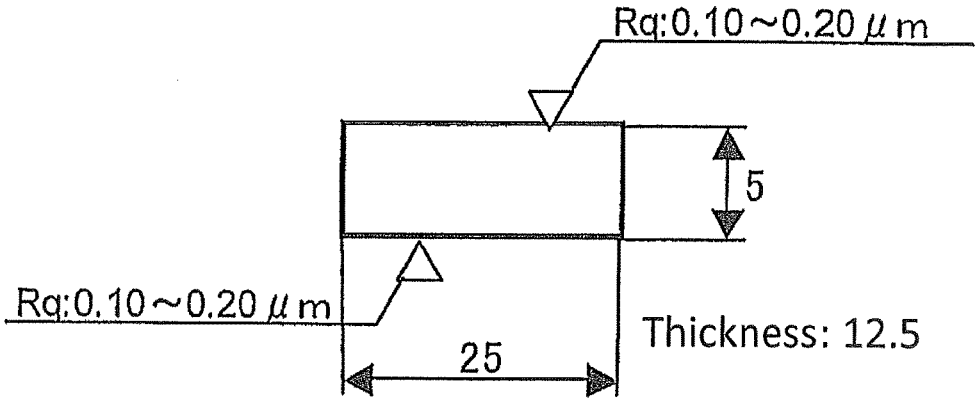
FIG. 6 is a view showing a shape of a block test piece B for investigating deformation resistance used in the EXAMPLES. In this figure, the units of the dimensions are "mm".

Similarly, from the central portion of the said cold drawn material, in parallel to the axial direction thereof, a block test specimen measuring 15.7 mm long, 10.16 mm wide, and 6.35 mm thick (hereinafter, referred to the "block test specimen A") shown in FIG. 5 and a block test specimen measuring 25 mm long, 5 mm wide, and 12.5 mm thick (hereinafter, referred to the "block test specimen B") shown in FIG. 6 were cut off.

The units of all the dimensions in the above cut-off test pieces shown in FIGS. 1 to 6 are "mm", and the finish marks of three kinds shown in the figures are the "triangular symbols" designating surface roughness described in Explanation Table 1 of JIS B 0601 (1982).

Figure 4:
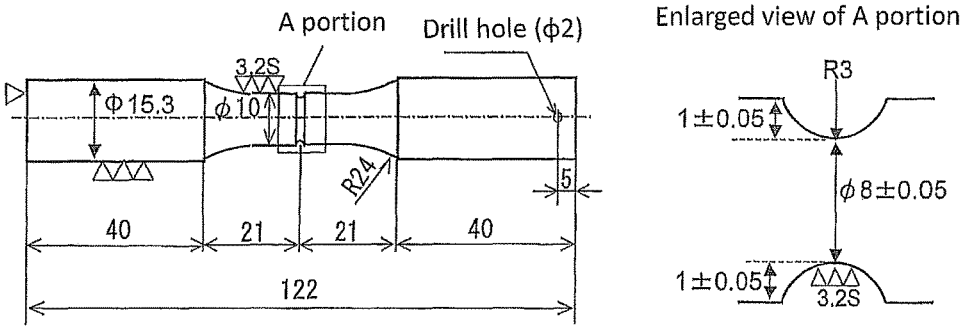
FIG. 4 is a view showing a rough shape of a notched Ono type rotating bending fatigue test piece as cut off condition from a cold drawn material used in the EXAMPLES. In this figure, the units of the dimensions are "mm".

The symbol "3.2 S" in FIG. 4 means that the maximum height Rmax is 3.2 μm or less. In addition, the "Rq: 0.10 to 0.20 μm" means that the root-mean-square roughness "Rq" specified in JIS B 0601 (2001) is 0.10 to 0.20 μm.

On the other hand, the normalized steel bar having the diameter of 45 mm was peeled to a diameter of 34.7 mm, being subjected to a pickling and lubricating treatment, and thereafter the said steel bar was carried out the cold drawing so that the diameter became 29 mm.

The diameters of dies used for the above drawing were 32.88 mm, 30.5 mm, and 29 mm in that order. Incidentally, the total reduction of area at the time when drawing was carried out from 34.7 mm to 29 mm in diameter was 30%.

With regard to each of the steels, the thus obtained cold drawn material having the diameter of 29 mm was cut to a length of 300 mm in order to prepare a test piece for investigation of machinability after drawing (that is to say, after cold working).

Figure 7:
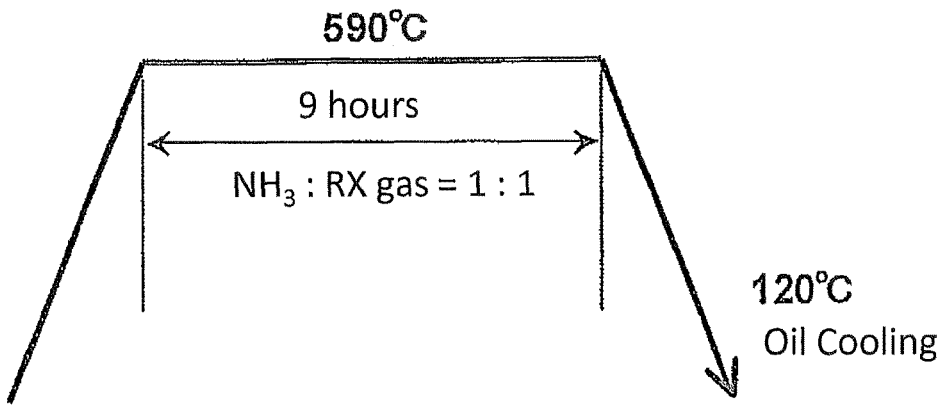
FIG. 7 is a diagram showing the heat pattern of nitrocarburizing carried out on the test pieces shown in FIGS. 3 to 6 in the EXAMPLES.

Among the thus prepared test pieces, the round bar test pieces having a diameter of 10 mm for measuring hardness and so on after nitriding, the notched Ono type rotating bending fatigue test pieces having the rough shape, the block test pieces A, and the block test pieces B were treated by nitriding. In the concrete, the "gas nitrocarburizing" using the heat pattern shown in FIG. 7 was carried out. Incidentally, the "120° C. Oil Cooling" in FIG. 7 means that the test pieces were cooled by being put in the oil having a temperature of 120° C.

Figure 8:
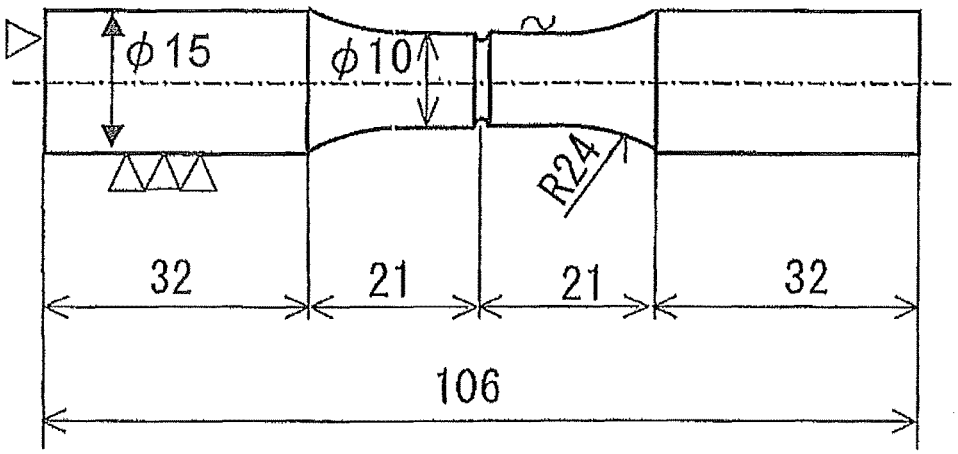
FIG. 8 is a view showing a finished shape of a notched Ono type rotating bending fatigue test piece used in the EXAMPLES. In this figure, the units of the dimensions are "mm".

The aforementioned notched Ono type rotating bending fatigue test pieces having the rough shape subjected to the said "gas nitrocarburizing" were finished to prepare the notched Ono type rotating bending fatigue test pieces shown in FIG. 8.

The units of the dimensions in the notched Ono type rotating bending fatigue test piece shown in FIG. 8 are "mm", and similarly in the above FIGS. 1 to 6, the finish marks of two kinds shown in FIG. 8 are the "triangular symbols" designating surface roughness described in Explanation Table 1 of JIS B 0601 (1982).

The "waveform symbol (wave dash)" in FIG. 8 means that the surface is not carried out a removal treatment, that is to say, the surface is "as-gas nitrocarburized condition".

By using the thus prepared test pieces, the tests described below were carried out.

Investigation 1: Vickers Hardness Test Before Cold Working

Being based on the "Vickers hardness test—Test method" described in JIS Z 2244 (2009), at a total of 5 points of 1 point in the central portion of the mirror-like finished each test piece for measurement of Vickers hardness before cold working and 4 points in the R/2 portion thereof, Vickers hardness was measured by using a Vickers hardness tester with the testing force being 9.8N; and the arithmetic mean value of the said 5 points was defined as the hardness before cold working.

Investigation 2: Microstructure Observation Before Cold Working

The mirror-like finished test pieces for observation of microstructure before cold working were etched with nital, and thereafter in order to identify the "phase", 5 fields of the R/2 portion thereof were observed using an optical microscope at a magnification of 400 times. In addition, from the obtained microstructure photographs, the area fraction of ferrite in each field was calculated by using an image processing software, and the arithmetic mean value of the said 5 fields was defined as the area fraction of ferrite.

Investigation 3: Extraction Residue Analysis

The specimens measuring 10 mm×10 mm×10 mm, which were cut off in order to carry out the extraction residue analysis, were electrolyzed at a constant current in a 10% AA type solution. That is to say, in order to remove the accretions on the surface, first, pre-electrolysis was carried out on the specimen under the conditions of electric current: 1000 mA and time: 28 minutes; and thereafter the accretions on the surface of the specimen were ultrasonically cleaned in alcohol and were removed from the specimen; and further, the mass of the specimen from which accretions had been removed was measured. The thus measured mass was defined as the mass of the specimen before the electrolysis being carried out in the next process.

Next, the specimen was electrolyzed under the conditions of electric current: 173 mA and time: 142 minutes. The thus electrolyzed specimen was taken out, and then, the accretions (residues) on the surface of the specimen were ultrasonically cleaned in alcohol and were removed from the specimen. Thereafter, in order to sample the residues, both the solution after the above electrolysis and the solution having been used for ultrasonic cleaning were suction-filtrated through a filter having a mesh size of 0.2 μm: and then, the mass of the specimen from which accretions (residues) had been removed was measured, and the thus measured mass was defined as the mass of the specimen after the electrolysis. From the difference between measured values of specimen masses before and after the said electrolysis, the "mass of the electrolyzed specimen" was determined.

The residues sampled on the filter were shifted onto a petri dish and were dried, and after the mass had been measured, the residues were subjected to an acidolysis treatment.

The solution subjected to the above acidolysis was analyzed by using an ICP emission analyzer (high-frequency inductively coupled plasma emission spectrophotometer) to determine the "mass of V in residues".

With regard to each of the steels, a value that was obtained by dividing the thus obtained "mass of V in residues" by the said "mass of the electrolyzed specimen", and by being represented in percentage was defined as the "content of V in precipitates determined by the extraction residue analysis".

Investigation 4: Vickers Hardness Test after Cold Working

Similarly in the above "Investigation 1", being based on JIS Z 2244 (2009), at a total of 5 points of 1 point in the central portion of the mirror-like finished each test piece for measurement of Vickers hardness after cold working and 4 points in the R/2 portion thereof, Vickers hardness was measured by using a Vickers hardness tester with the testing force being 9.8N; and the arithmetic mean value of the said 5 points was defined as the hardness after cold working.

Investigation 5: Measurement of the Deformation Resistance in Cold Forging

The smoothed test pieces shown in FIG. 1 were cold compressed by end face restrained compression at respective compression ratios of 10%, 20%, 30%, 40%, 50% and 60%, and the deformation resistance at that time was measured. With regard to the said deformation resistance, an average deformation resistance (nominal pressure/apparent constraint coefficient) was calculated according to the method described in Table 5.2 on page 158 of "Forging" (1997, the second impression of the first edition, Corona Publishing Co., Ltd.) edited by the Japan Society for Technology of Plasticity.

Next, with regard to each of the steels, an approximate curve of 6 plots was prepared in such a manner that the horizontal axis corresponds to the logarithmic strain and the vertical axis corresponds to the deformation resistance. Using the thus obtained approximate curve, the deformation resistance at the time when the logarithmic strain did be 1.0 was determined; and in the case where the value of the thus determined deformation resistance was 600 MPa or less, the cold forgeability was supposed to be excellent, and so this value was defined as the target. The above "logarithmic strain" means an average logarithmic strain s in Table 5.2 on page 158 of the said "Forging" edited by the Japan Society for Technology of Plasticity.

Investigation 6: Measurement of the Critical Compression Ratio in Cold Forging

Figure 2:
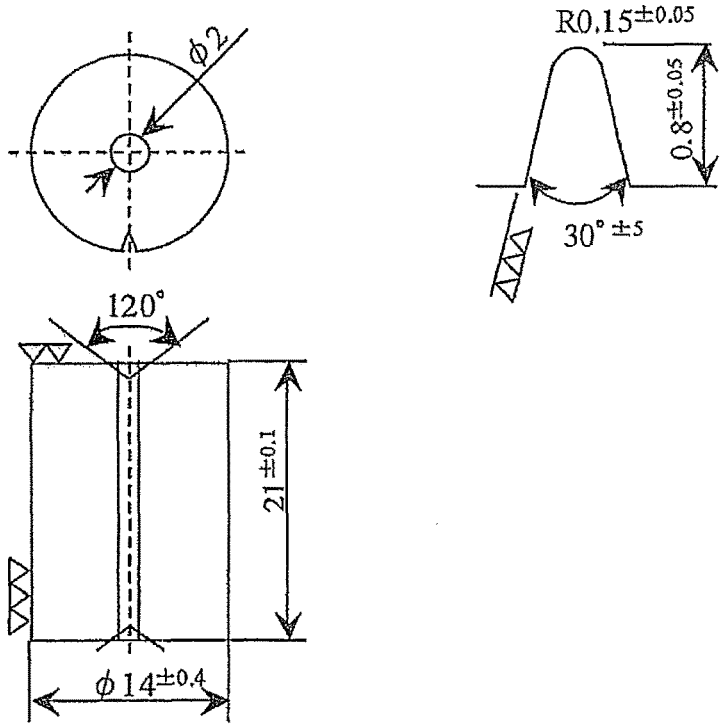
FIG. 2 is a view showing a shape of a notched test piece for measuring critical compression ratio at the time of cold forging used in the EXAMPLES. In this figure, the units of the dimensions are "mm".

The notched test pieces shown in FIG. 2 were cold compressed until a crack occurred in the notched portion under the macroscopic observation, and the compression ratio at the time of crack occurrence was determined. With regard to each of 5 test pieces, the compression ratio at the time of crack occurrence was determined respectively; and the compression ratio of the third test piece at the time when the 5 test pieces were arranged in ascending order of compression ratio was defined as the critical compression ratio. In the case where the thus defined critical compression ratio was 60% or more, the cold forgeability was supposed to be excellent, and so this value was defined as the target.

Investigation 7: Machinability Test

Using an NC lathe, the machinability was investigated by turning the outer circumference portion of a test piece that had been cold drawn so as to have a diameter of 29 mm and thereafter had been cut to a length of 300 mm.

The above turning was carried out by using a cemented carbide tool consisting mainly of WC, not provided with a chip breaker, under the conditions of cutting speed: 150 m/min, depth of cut: 0.2 mm, and feed rate: 0.8 mm/rev, and in the state of being lubricated with a water-soluble lubricant. By using a cutting dynamometer, the machinability after cold working was evaluated by the cutting force and the chip disposability at the time of turning.

The cutting force was evaluated by determining the resultant force of main cutting force component, feed cutting force component, and thrust cutting force component by the following formula;

$$\text{Cutting force}=\{(\text{main cutting force component})^2+(\text{feed cutting force component})^2+(\text{thrust cutting force component})^2\}^{0.5}.$$

In the case where the thus evaluated cutting force was 640N or less, the cutting force was supposed to be small, and so this value was defined as the target.

Figure 9:
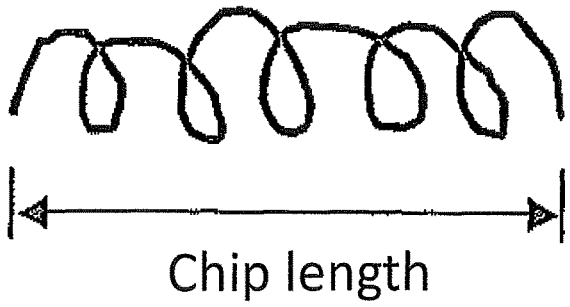
FIG. 9 is a view for explaining the length of a chip produced by turning using an NC lathe in the EXAMPLES.

The chip disposability was evaluated as described below. With regard to each of the steels, from optional 10 chips after turning, a chip in which the chip length shown in FIG. 9 was at a maximum was selected, and in order to evaluate the chip disposability, the length thereof was measured. The chip disposability was evaluated as "Excellent (○○)", "Good (○)", and "Poor (x)" in the case where the chip length was not more than 5 mm, in the case where it was more than 5 mm and not more than 10 mm, and in the case where it was more than 10 mm, respectively.

In the case where the said cutting force was low, being 640N or less, and the said chip disposability was evaluated as Excellent or Good (○○ or ○), the machinability was supposed to be excellent, and so this value and this evaluation were defined as the targets.

Investigation 8: Measurement of the Core Hardness, Surface Hardness, and Effective Case Depth after Nitriding (Gas Nitrocarburizing)

The round bar test piece having a diameter of 10 mm which had been subjected to the said gas nitrocarburizing was cut transversely. Next, the cut round bar test piece was embedded in a resin so that the cut plane did be the test plane. Thereafter the above embedded cut round bar test piece was mirror-like finished, and the core hardness was measured using a Vickers hardness tester. In addition, by using a micro-Vickers tester, the surface hardness and the effective case depth were investigated.

In the concrete, being based on JIS Z 2244 (2009), at a total of 5 points of 1 point in the central portion of the mirror-like finished test piece and 4 points in the R/2 portion thereof, Vickers hardness was measured by using the Vickers hardness tester with the testing force being 9.8N, and the arithmetic mean value of the said 5 points was defined as the "core hardness".

Similarly in the above-described case, being based on JIS Z 2244 (2009), by using the same embedded test piece, at optional 10 points at a position 0.01 mm deep from the surface of each test piece, HV was measured by using the micro-Vickers tester with the testing force being 0.98N, and the arithmetic mean value of the ten points was defined as the "surface hardness".

Furthermore, by using the same embedded test piece, being based on JIS Z 2244 (2009), HV were measured successively from the surface of the mirror-like finished test piece by using the micro-Vickers tester with the testing force being 1.96N, and the distribution map of HV was prepared. The distance from the surface to the position at which HV did be 550 was defined as the "effective case depth".

Investigation 9: Ono Type Rotating Bending Fatigue Test

By using Ono type rotating bending fatigue test pieces having been finished after the said nitriding (nitrocarburizing), the Ono type rotating bending fatigue test was carried out under the test conditions described below, and the maximum strength at which the test piece did not rupture in the number of cycles of $10^7$ was defined as the "rotating bending fatigue strength". In the case where the rotating bending fatigue strength was 450 MPa or more, the thus defined rotating bending fatigue strength was supposed to be excellent, and so this value was defined as the target.

Temperature: room temperature,

Atmosphere: in the air,

Number of revolutions: 3000 rpm.

Investigation 10: Investigation of the Wear Resistance

Figure 10:
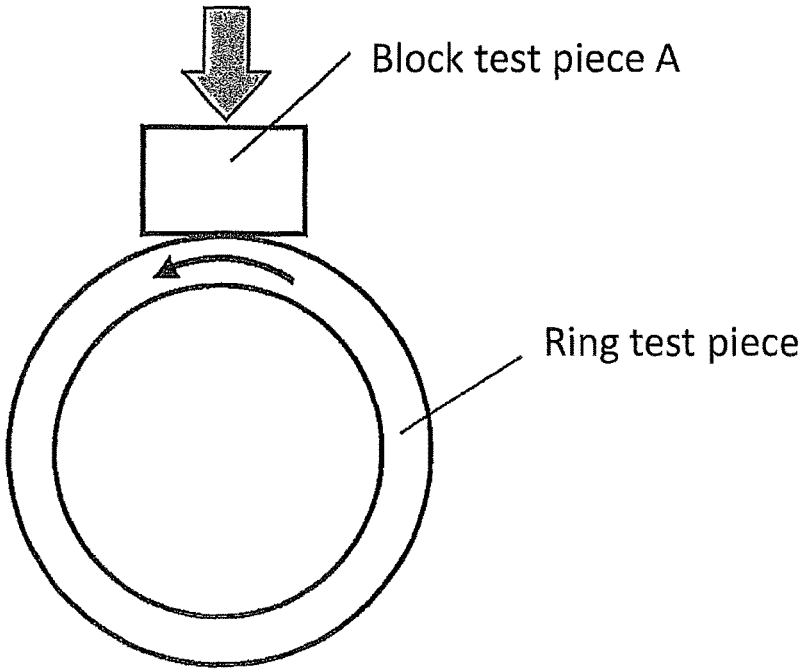
FIG. 10 is a view for explaining a method for a block-on-ring wear test carried out in the EXAMPLES.

The wear resistance was investigated by the block-on-ring wear test. That is to say, as shown in FIG. 10, the plane having a length of 15.75 mm and a thickness of 6.35 mm (hereinafter, referred to as the "test plane") of the said nitrided (nitrocarburized) block test piece A was pushed against a ring test piece, and the said ring test piece was rotated, whereby the wear test was carried out.

In the concrete, 100 milliliters of a commercial automatic transmission oil was put in a test chamber as a lubricating oil, the temperature thereof being raised to 90° C., thereafter the test plane of the block test piece A was pushed against the ring test piece with a testing force of 1000N, and the ring test piece was rotated until the total slipping distance became 8000 m with the slipping velocity being 0.1 m/second.

The above ring test piece was prepared as described below. From a steel bar having a diameter of 45 mm of SCM420 specified in JIS G 4053 (2008), a test piece approximately having the shape shown in FIG. 11 was cut off with the axial direction thereof being aligned with the steel bar, and the said cut-off test piece was subjected to the gas "carburizing and quenching" and tempering with the heat patterns shown in FIG. 12, thereafter the outer circumference portion thereof being ground by 100 μm, and thereby the test piece was finished to the size and shape shown in FIG. 11.

Figure 11:
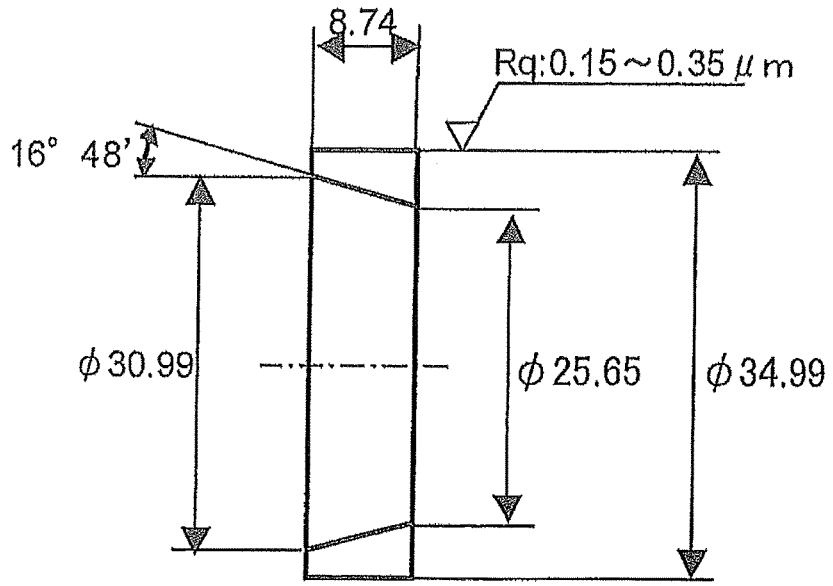
FIG. 11 is a view showing a shape of a ring test piece used for the block-on-ring wear test in the EXAMPLES. In this figure, the units of the dimensions are "mm".

The units of the dimensions in the above ring test piece shown in FIG. 11 are "mm", and the finish mark shown in the said FIG. 11 is the "triangular symbol" designating surface roughness described in Explanation Table 1 of JIS B 0601 (1982). In addition, the "Rq: 0.15 to 0.35 μm" attached to the triangular symbol means that the root-mean-square roughness "Rq" specified in JIS B 0601 (2001) is 0.15 to 0.35 μm.

Figure 12:
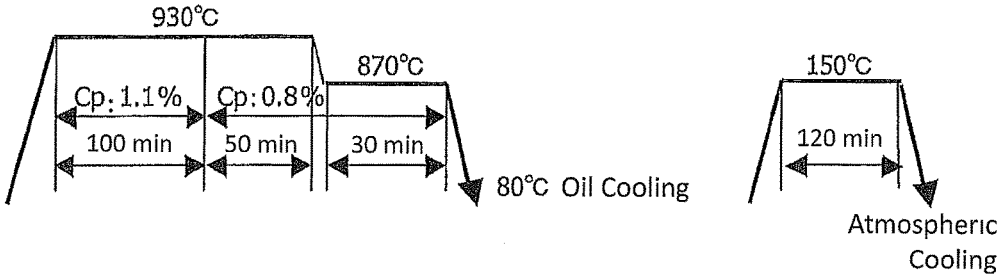
FIG. 12 are diagrams showing the heat patterns of gas "carburizing and quenching" and tempering carried out on the ring test piece before finish grinding in the EXAMPLES.

The "Cp" in FIG. 12 represents carbon potential. In addition, the "80° C. Oil Cooling" means that the ring test piece was cooled by being put in the oil having a temperature of 80° C.

Figure 13:
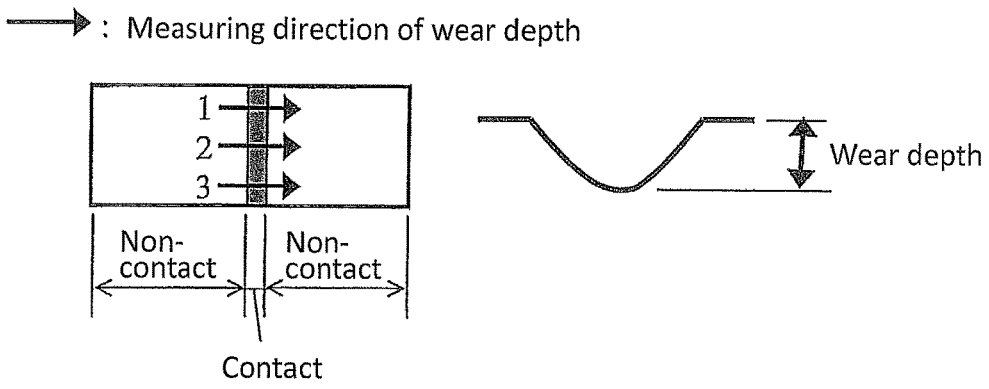
FIG. 13 is a view for explaining a method for measuring a wear depth after the block-on-ring wear test carried out in the EXAMPLES.

After the finish of the said block-on-ring wear test, by using a surface roughness tester, the surface roughness of the test plane of the block test piece A was measured continuously in the order of non-contact portion, contact portion, and non-contact portion as indicated by arrow marks 1, 2, and 3 in FIG. 13. And then, in the obtained each cross-sectional curve, the largest difference between the non-contact portion and the contact portion was defined as an each wear depth. As shown in FIG. 13, with regard to the each block test piece A, three wear depths were determined, and the mean value thereof was defined as the wear depth. In the case where the thus defined wear depth was 10.0 μm or less, the wear resistance was supposed to be excellent, and so this value was defined as the target.

The "non-contact portion" and "contact portion" mentioned above means the "non-contact portion" and "contact portion" with the ring test piece.

Investigation 11: Investigation of the Deformation Resistance

Figure 14:
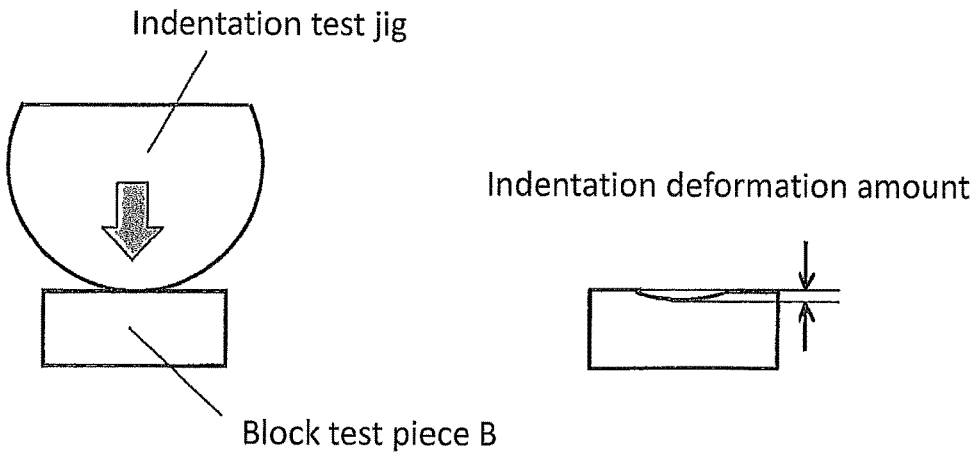
FIG. 14 is a view for explaining a method for an indentation test carried out in the EXAMPLES.

The deformation resistance was investigated by an indentation test. That is to say, as shown in FIG. 14, an indentation test jig having the shape shown in FIG. 15 was pushed into the plane having a length of 25 mm and a thickness of 12.5 mm (hereinafter, referred to as the "test plane") of the said nitrided (nitrocarburized) block test piece B, whereby the deformation resistance was investigated. The said indentation test jig was prepared as described below like the ring test piece for the block-on-ring wear test. From a steel bar having a diameter of 45 mm of SCM420 specified in JIS G 4053 (2008), a test piece approximately having the shape shown in FIG. 15 was cut off with the axial direction thereof being aligned with the steel bar. The said cut-off test piece was subjected to the gas "carburizing and quenching" and tempering with the heat patterns shown in FIG. 12, thereafter the outer circumference portion thereof being ground by 100 μm, and thereby the test piece was finished to the size and shape shown in FIG. 15.

In the concrete, by using an oil hydraulic servo testing machine, the indentation test jig was pushed into the test plane of the block test piece B with a testing force of 5000N. After the testing force had been relieved, similarly in the Investigation 10, the indentation deformation amount in the test plane of the block test piece B was measured in three locations by using the surface roughness tester, and the mean value of three locations was defined as the indentation deformation amount. In the case where the thus defined indentation deformation amount was 5.0 μm or less, the deformation resistance was supposed to be excellent, and so this value was defined as the target.

Figure 15:
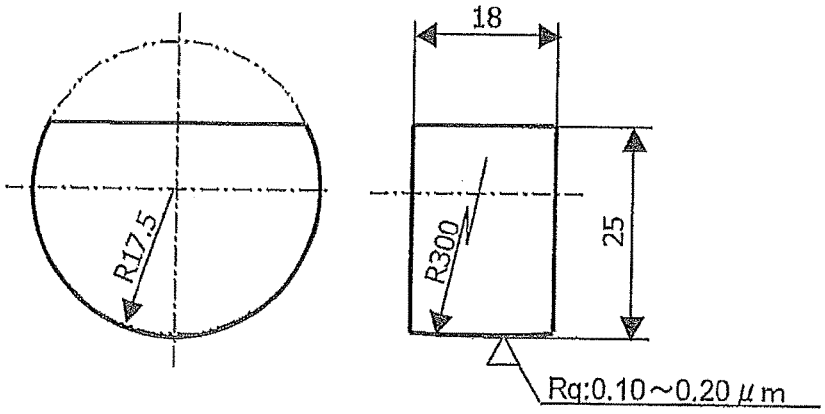
FIG. 15 is a view showing a shape of an indentation test jig used for the indentation test in the EXAMPLES. In this figure, the units of the dimensions are "mm".

The units of the dimensions in the above indentation test jig shown in FIG. 15 are "mm", and the finish mark shown in the said FIG. 15 is the "triangular symbol" designating surface roughness described in Explanation Table 1 of JIS B 0601 (1982). In addition, the "Rq: 0.10 to 0.20 μm" attached to the triangular symbol means that the root-mean-square roughness "Rq" specified in JIS B 0601 (2001) is 0.10 to 0.20 μm.

The test results of the Investigations 1 to 7 are collectively shown in Table 2, and the test results of the Investigations 8 to 11 are collectively shown in Table 3. In Table 3, the hardness (HV) after cold working in the Investigation 4 is also given. Incidentally, the "ΔHV" in Table 3 means the age hardening amount due to nitriding hardness, that is to say, it means the difference between the core hardness (HV) after nitriding (nitrocarburizing) and the hardness (HV) after cold working.

Figure 16:
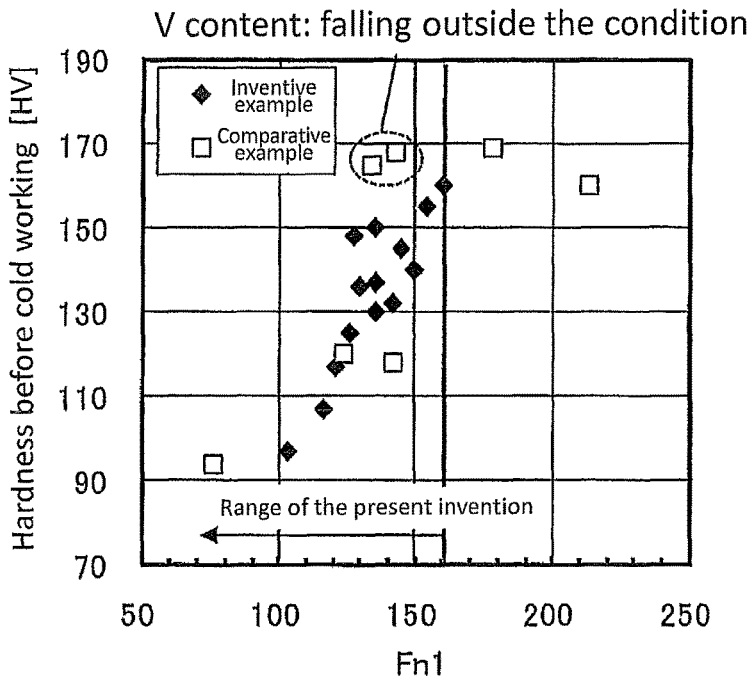
FIG. 16 is a graph summarizing the relationship between the Fn1 expressed by the formula (1) and the hardness (HV) before cold working in the Investigation 1 in the EXAMPLES.
Figure 17:
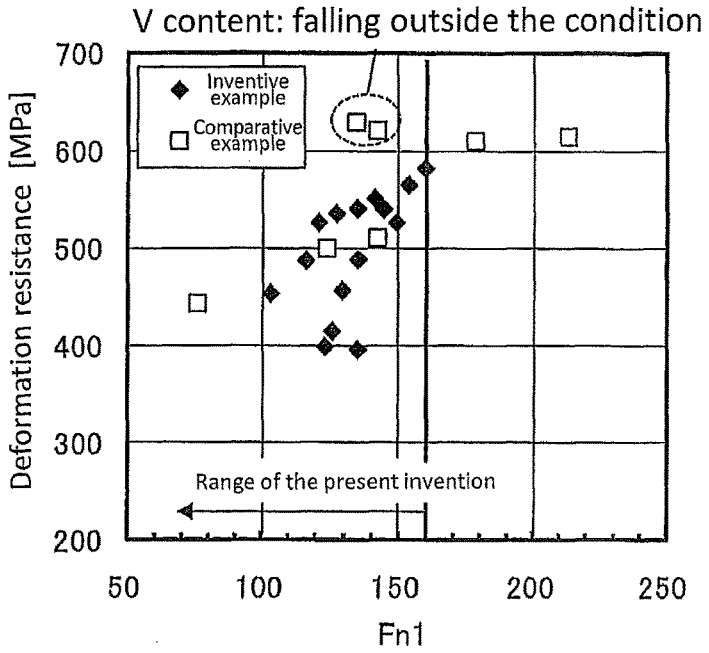
FIG. 17 is a graph summarizing the relationship between the Fn1 expressed by the formula (1) and the deformation resistance in cold forging in the Investigation 5 in the EXAMPLES.
Figure 18:
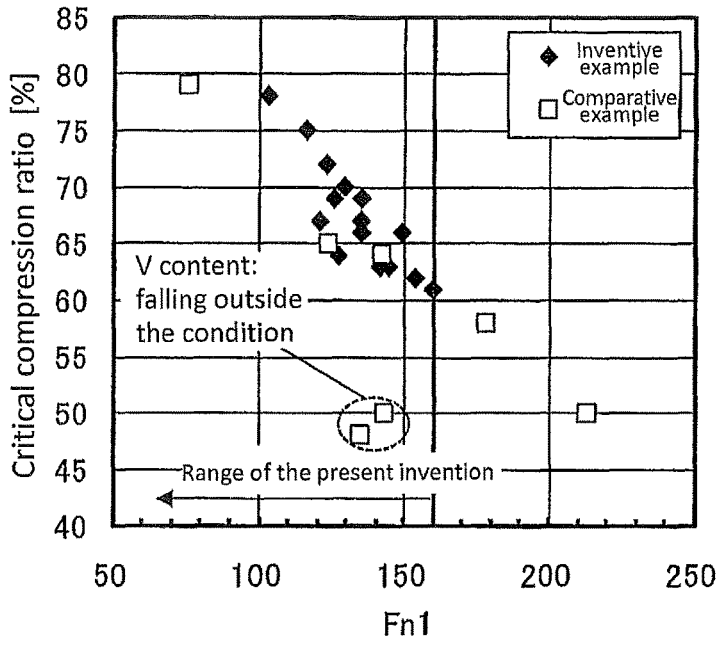
FIG. 18 is a graph summarizing the relationship between the Fn1 expressed by the formula (1) and the critical compression ratio in cold forging in the Investigation 6 in the EXAMPLES.

Among the above test results, the relationship between the Fn1 and the hardness (HV) before cold working in the Investigation 1, the relationship between the Fn1 and the deformation resistance in cold forging in the Investigation 5, and the relationship between the Fn1 and the critical compression ratio in cold forging in the Investigation 6 are summarized in FIGS. 16 to 18, respectively.

Figure 19:
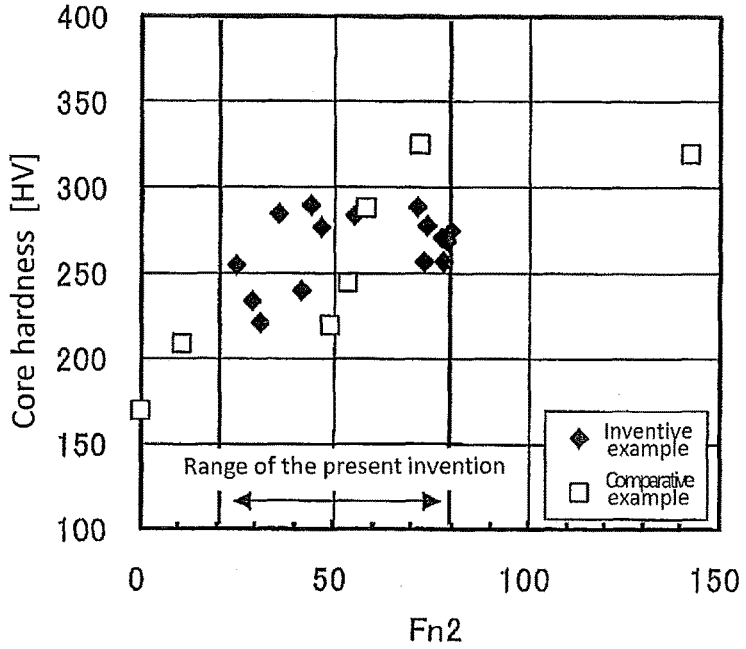
FIG. 19 is a graph summarizing the relationship between the Fn2 expressed by the formula (2) and the core hardness (HV) after nitriding in the Investigation 8 in the EXAMPLES.
Figure 20:
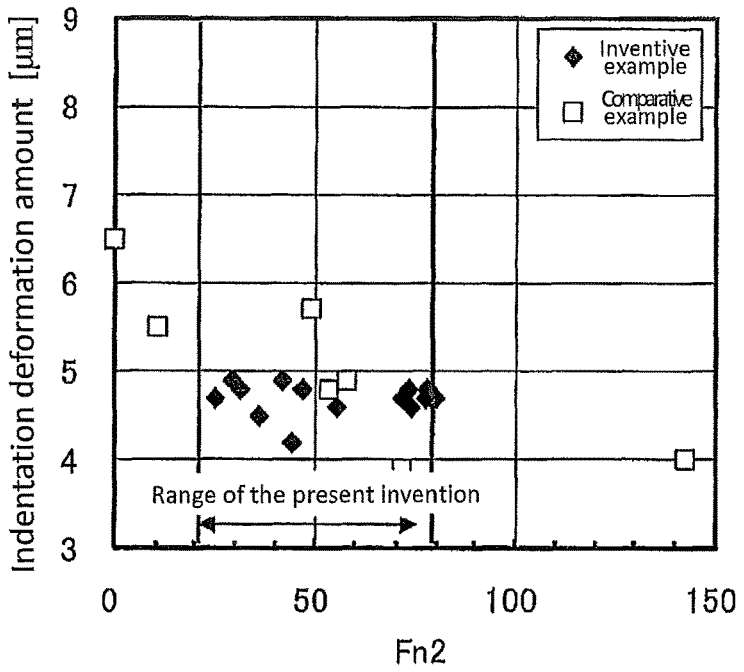
FIG. 20 is a graph summarizing the relationship between the Fn2 expressed by the formula (2) and the indentation deformation amount in the Investigation 11 in the EXAMPLES.

FIGS. 19 and 20 summarize the relationship between the Fn2 and the core hardness (HV) after nitriding in the Investigation 8 and the relationship between the Fn2 and the indentation deformation amount in the Investigation 11, respectively.

Figure 21:
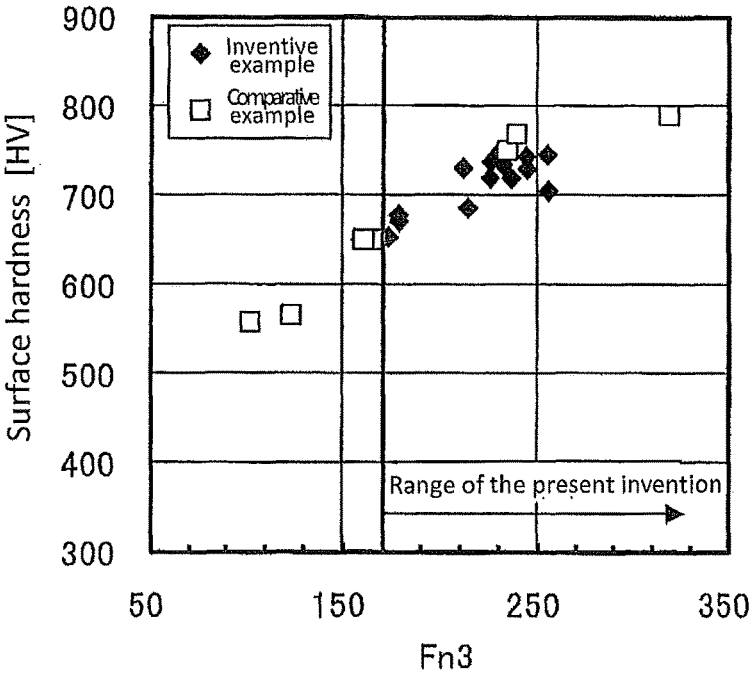
FIG. 21 is a graph summarizing the relationship between the Fn3 expressed by the formula (3) and the surface hardness (HV) after nitriding in the Investigation 8 in the EXAMPLES.
Figure 22:
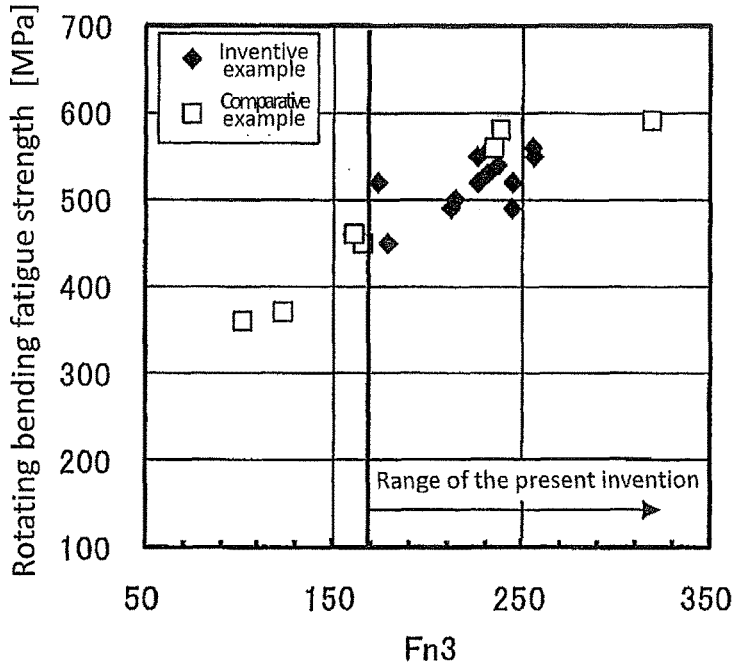
FIG. 22 is a graph summarizing the relationship between the Fn3 expressed by the formula (3) and the rotating bending fatigue strength in the Investigation 9 in the EXAMPLES.
Figure 23:
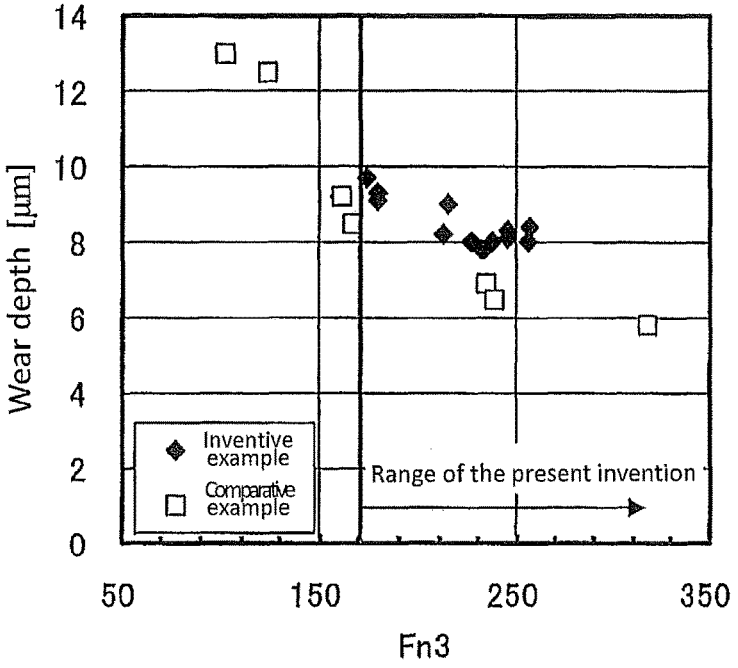
FIG. 23 is a graph summarizing the relationship between the Fn3 expressed by the formula (3) and the wear depth in the Investigation 10 in the EXAMPLES.

FIGS. 21 to 23 summarize the relationship between the Fn3 and the surface hardness (HV) after nitriding in the Investigation 8, the relationship between the Fn3 and the rotating bending fatigue strength in the Investigation 9, and the relationship between the Fn3 and the wear depth in the Investigation 10, respectively.

Figure 24:
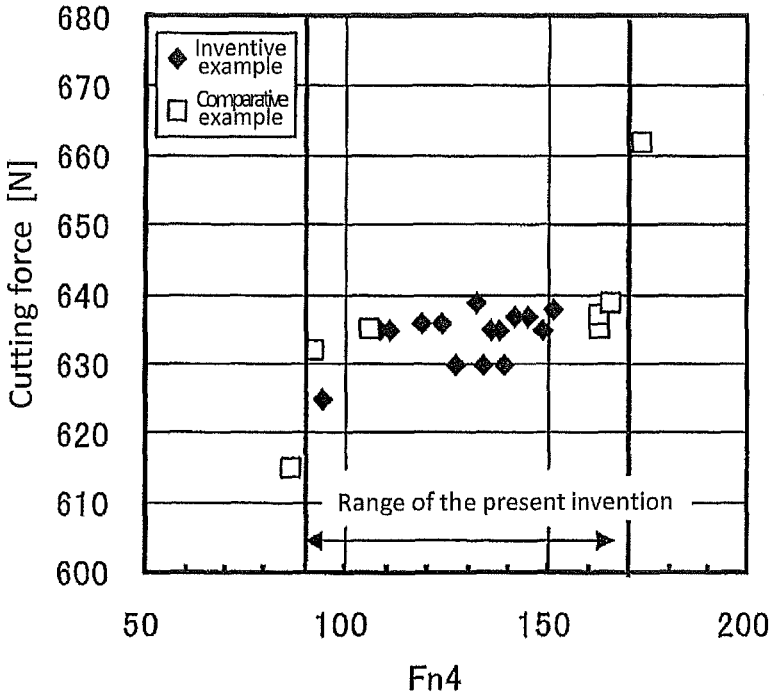
FIG. 24 is a graph summarizing the relationship between the Fn4 expressed by the formula (4) and the cutting force in the Investigation 7 in the EXAMPLES.

FIG. 24 summarizes the relationship between the Fn4 and the cutting force in the Investigation 7.

TABLE 2

| Division | Test No. | Steel | Microstructure: Phase | Microstructure: Area fraction of ferrite (%) | Content of V in precipitates (%) | HV before cold working | HV after cold working | Cold forgeability: Deformation resistance (MPa) | Cold forgeability: Critical compression ratio (%) | Machinability: Cutting force (N) | Machinability: Chip disposability |
|---|---|---|---|---|---|---|---|---|---|---|---|
| Inventive examples | 1 | 1 | F + P | 96 | 0.06 | 97 | 201 | 453 | 78 | 625 | ○ |
| | 2 | 2 | F + P | 90 | 0.06 | 107 | 209 | 487 | 75 | 635 | ○ |
| | 3 | 3 | F + P | 80 | 0.05 | 132 | 228 | 551 | 63 | 639 | ○ |
| | 4 | 4 | F + P | 85 | 0.03 | 120 | 206 | 398 | 72 | 635 | ○ |
| | 5 | 5 | F + P | 83 | 0.06 | 125 | 211 | 414 | 69 | 630 | ○ |
| | 6 | 6 | F + P | 88 | 0.07 | 136 | 217 | 456 | 70 | 635 | ○ |
| | 7 | 7 | F + P | 72 | 0.03 | 130 | 218 | 395 | 69 | 636 | ○ |
| | 8 | 8 | F + P | 86 | 0.07 | 137 | 229 | 488 | 66 | 630 | ○○ |
| | 9 | 9 | F + P | 87 | 0.07 | 148 | 226 | 535 | 64 | 635 | ○○ |
| | 10 | 10 | F + P | 90 | 0.06 | 117 | 212 | 526 | 67 | 636 | ○ |
| | 11 | 11 | F + P | 79 | 0.06 | 145 | 240 | 540 | 63 | 637 | ○ |
| | 12 | 12 | F + P | 89 | 0.06 | 150 | 251 | 540 | 67 | 635 | ○○ |
| | 13 | 13 | F + P | 85 | 0.06 | 140 | 232 | 526 | 66 | 638 | ○○ |
| | 14 | 14 | F + P + B | 72 | 0.05 | 155 | 250 | 565 | 62 | 630 | ○ |
| | 15 | 15 | F + B | 71 | 0.04 | 160 | 260 | 582 | 61 | 637 | ○ |
| Comparative examples | 16 | * 16 | F + P + B | ** 69 | — | 160 | 245 | # 615 | # 50 | 635 | ○ |
| | 17 | * 17 | F + P + B | 72 | 0.10 | 169 | 265 | # 610 | # 58 | 637 | ○ |
| | 18 | * 18 | F + P | 85 | 0.02 | 120 | 208 | 500 | 65 | 632 | ○ |
| | 19 | * 19 | F + P | 80 | 0.03 | 118 | 228 | 510 | 64 | 635 | ○ |
| | 20 | * 20 | F + P + B | 70 | ** 0.18 | 168 | 265 | # 620 | # 50 | 639 | ○ |
| | 21 | * 21 | F + P | 97 | 0.08 | 94 | 187 | 443 | 79 | 615 | # x |
| | 22 | * 22 | F + P + B | ** 50 | ** 0.20 | 165 | 275 | # 630 | # 48 | # 662 | ○ |

In the column of "Microstructure", "F", "P" and "B" denote ferrite, pearlite and bainite respectively.

With regard to the Test No. 16, the used steel 16 did contain no V; thus the mark "—" in the column of "Content of V in precipitates" denotes that V was not detected in the precipitates.

The mark "*" denotes falling outside the conditions of chemical composition regulated by the present invention.

The mark "**" denotes falling outside the conditions of "Microstructure", or "Content of V in precipitates" which was determined by the extraction residue analysis.

The mark "#" denotes falling short of the target in the present invention.

TABLE 3

| Division | Test No. | Steel | Hardness after cold working [HV] | Hardness after nitriding: Core hardness [HV] | Hardness after nitriding: Surface hardness [HV] | Age hardening: amount due to nitriding [ΔHV] | Effective case depth (mm) | Rotating bending fatigue strength (MPa) | Wear depth (μm) | Indentation deformation amount (μm) |
|---|---|---|---|---|---|---|---|---|---|---|
| Inventive examples | 1 | 1 | 201 | 221 | 650 | 20 | 0.21 | 460 | 9.2 | 4.8 |
| | 2 | 2 | 209 | 255 | 744 | 46 | 0.27 | 490 | 8.1 | 4.7 |
| | 3 | 3 | 228 | 284 | 730 | 56 | 0.24 | 520 | 8.3 | 4.6 |
| | 4 | 4 | 206 | 234 | 671 | 28 | 0.22 | 450 | 9.3 | 4.9 |
| | 5 | 5 | 211 | 257 | 731 | 46 | 0.29 | 490 | 8.2 | 4.8 |
| | 6 | 6 | 217 | 271 | 738 | 54 | 0.35 | 520 | 8.0 | 4.7 |
| | 7 | 7 | 218 | 240 | 678 | 22 | 0.20 | 450 | 9.1 | 4.9 |
| | 8 | 8 | 229 | 269 | 686 | 40 | 0.26 | 500 | 9.0 | 4.7 |
| | 9 | 9 | 226 | 275 | 751 | 49 | 0.32 | 530 | 7.8 | 4.7 |
| | 10 | 10 | 212 | 257 | 653 | 45 | 0.22 | 520 | 9.7 | 4.8 |
| | 11 | 11 | 240 | 277 | 720 | 37 | 0.33 | 540 | 8.0 | 4.8 |
| | 12 | 12 | 251 | 289 | 746 | 38 | 0.35 | 560 | 8.0 | 4.7 |
| | 13 | 13 | 232 | 278 | 705 | 46 | 0.28 | 550 | 8.4 | 4.6 |
| | 14 | 14 | 250 | 285 | 720 | 35 | 0.34 | 550 | 8.0 | 4.5 |
| | 15 | 15 | 260 | 290 | 735 | 30 | 0.35 | 560 | 7.8 | 4.2 |
| Comparative examples | 16 | * 16 | 245 | $ 169 | $ 566 | −76 | $ 0.10 | # 370 | # 12.5 | # 6.5 |
| | 17 | * 17 | 265 | 288 | 750 | 23 | 0.36 | 560 | 6.9 | 4.9 |
| | 18 | * 18 | 208 | $ 209 | 650 | 1 | $ 0.12 | 450 | 8.5 | # 5.5 |
| | 19 | * 19 | 228 | 245 | $ 560 | 17 | $ 0.15 | # 360 | # 13.0 | 4.8 |
| | 20 | * 20 | 265 | 320 | 771 | 55 | 0.35 | 580 | 6.5 | 4.0 |
| | 21 | * 21 | 187 | 220 | 651 | 33 | 0.20 | 460 | 9.2 | # 5.7 |
| | 22 | * 22 | 275 | 325 | 791 | 50 | 0.30 | 590 | 5.8 | 3.9 |

"Age hardening amount due to nitriding" denotes the difference between the core hardness after nitriding and the hardness after cold working.

The mark "*" denotes falling outside the conditions of chemical composition regulated by the present invention.

The mark "$" denotes falling outside the conditions of the properties after nitriding regulated by the present invention.

The mark "#" denotes falling short of the target in the present invention.

From Tables 2 and 3, it is apparent that, in the case of test Nos. 1 to 15 of the "inventive examples" in which the starting material before nitriding satisfied the conditions regulated by the present invention, both excellent cold forgeability and excellent machinability after cold working were ensured. Moreover, in the case of the said test numbers, all conditions of the core hardness, surface hardness, and effective case depth regulated by the present invention were satisfied after nitriding, and thus excellent deformation resistance, high bending fatigue strength and excellent wear resistance were ensured.

It is apparent that, among the "inventive examples", in the case of test Nos. 8, 9, 12 and 13, in which the steel 8 containing Pb and Ca, the steel 9 containing Se and Sb, the steel 12 containing Te, and the steel 13 containing Bi were used respectively, the machinability after cold working was also excellent.

In contrast, in the case of test No. 16 of the "comparative example", the contents of C and N of the used steel 16 were so large as to exceed the range regulated by the present invention, the Fn1 was 213 and deviated from the restriction of the present invention of being "160 or less", and moreover the area fraction of ferrite in the ferritic-pearlitic-bainitic structure was 69%; thus the cold forgeability was poor, that is to say in the concrete, the deformation resistance was 615 MPa and the critical compression ratio was 50%. In addition, the Fn2 of the steel 16 was zero and deviated from the range of "20 to 80" regulated by the present invention, and moreover the core hardness after nitriding was lower than the value regulated by the present invention, being 169 in HV: thus the deformation resistance was poor, that is to say in the concrete, the indentation deformation amount was as large as 6.5 μm. Furthermore, with regard to the steel 16, since V was not contained, the Fn3 was 124 and deviated from the restriction of the present invention of "160 or more", additionally the effective case depth after nitriding was 0.10 mm, which was smaller than the value regulated by the present invention, the surface hardness after nitriding was 566 in HV, which was lower than the value regulated by the present invention; thus the bending fatigue strength was as low as 370 MPa, and moreover the wear resistance was poor, that is to say in the concrete, the wear depth was as large as 12.5 μm.

In the case of test No. 17, the Fn1 of the used steel 17 was 178 and deviated from the restriction of the present invention of being "160 or less"; thus the cold forgeability was poor, that is to say in the concrete, the deformation resistance was 610 MPa and the critical compression ratio was 58%.

In the case of test No. 18, the Fn2 of the used steel 18 was 11 and deviated from the range of "20 to 80" regulated by the present invention, the age hardening amount was small, and the core hardness after nitriding was 209 in HV, which was lower than the value regulated by the present invention. Consequently, the deformation resistance was poor, that is to say in the concrete, the indentation deformation amount was as large as 5.5 μm.

In the case of test No. 19, the Fn3 of the used steel 19 was 102 and deviated from the restriction of the present invention of being "160 or more"; thus the effective case depth after nitriding was 0.15 mm, which was smaller than the value regulated by the present invention, and in addition, the surface hardness after nitriding was 560 in HV, which was lower than the value regulated by the present invention; and thus the bending fatigue strength was as low as 360 MPa, and moreover the wear resistance was poor, that is to say in the concrete, the wear depth was as large as 13.0 μm.

In the case of test No. 20, the content of V of the used steel 20 was as high as 0.55%, which was higher than the value regulated by the present invention. Consequently, the content of V in precipitates determined by the extraction residue analysis was as high as 0.18%; thus the cold forgeability was poor, that is to say in the concrete, the deformation resistance was 620 MPa and the critical compression ratio was 50%.

In the case of test No. 21, the Fn4 of the used steel 21 was 86, which was smaller than the range of "90 to 170" regulated by the present invention; thus the chip disposability was deteriorated, and therefore the machinability after cold working was poor.

In the case of test No. 22, the content of V of the used steel 22 was as high as 0.59%, which was higher than the value regulated by the present invention. Consequently, the content of V in precipitates determined by the extraction residue analysis was as high as 0.20%; thus the cold forgeability was poor, that is to say in the concrete, the deformation resistance was 630 MPa and the critical compression ratio was 48%. In addition, the Fn4 was 173, which was larger than the range of "90 to 170" regulated by the present invention; thus the cutting force was high, and therefore the machinability after cold working was also poor.

INDUSTRIAL APPLICABILITY

The steel for cold forging/nitriding and the steel material for cold forging/nitriding of the present invention are excellent in cold forgeability and machinability after cold forging, and also can provide a component subjected to a cold forging and nitriding treatment with high core hardness and high surface hardness and a large effective case depth. Therefore, the steel for cold forging/nitriding and the steel material for cold forging/nitriding of the present invention are used suitably as a starting material for a cold-forged/nitrided component.

In addition, the cold-forged/nitrided component of the present invention is excellent in deformation resistance, bending fatigue strength, and wear resistance; and therefore it can be used suitably as a component for machine structural use that is used for an automobile transmission and the like, such as a gear and a pulley for a CVT.

The invention claimed is:

1. A steel for cold forging/nitriding, having a chemical composition consisting of by mass percent, C: 0.07 to 0.15%, Si: 0.35% or less, Mn: 0.10 to 0.90%, P: 0.030% or less, S: 0.003 to 0.030%, Cr: 0.50 to 2.0%, V: 10 to 0.50%, Al: 0.02 to 0.07%, N: 0.0080% or less, and O: 0.0030% or less, with the balance being Fe and impurities, and further the Fn1 expressed by the formula (1) is 160 or less, the Fn2 expressed by the formula (2) is 20 to 80, the Fn3 expressed by the formula (3) is 160 or more, and the Fn4 expressed by the formula (4) is 90 to 170;

$$Fn1 = 399\times C+26\times Si+123\times Mn+30\times Cr+19\times V \quad (1),$$

$$Fn2=(669.3\times \log_e C-1959.6\times \log_e N-6983.3)\times(0.147\times V) \quad (2),$$

$$Fn3=140\times Cr+125\times Al+235\times V \quad (3),$$

$$Fn4=511\times C+33\times Mn+36\times Cr+134\times V \quad (4);$$

wherein each symbol C, Si, Mn, Cr, V, N, and Al in the above formulas (1) to (4) represents the content by mass percent of the element concerned.

2. A steel material for cold forging/nitriding having a chemical composition according to claim 1, wherein the microstructure thereof is a ferritic-pearlitic structure, a ferritic-bainitic structure, or a ferritic-pearlitic-bainitic structure, and the area fraction of ferrite is 70% or more, and further the content of V in precipitates determined by extraction residue analysis is 0.10% or less.

3. A cold-forged/nitrided component having a chemical composition according to claim 1, wherein a core hardness thereof is 220 or more in Vickers hardness, a surface hardness thereof is 650 or more in Vickers hardness, and an effective case depth thereof is 0.20 mm or more.

4. A steel for cold forging/nitriding, having a chemical composition consisting of, by mass percent, C: 0.07 to 0.15%, Si: 0.35% or less, Mn: 0.10 to 0.90%, P: 0.030% or less, S: 0.003 to 0.030%, Cr: 0.50 to 2.0%, V: 0.10 to 0.50%, Al: 0.02 to 0.07%, N: 0.0080% or less, O: 0.0030% or less, and one or more elements selected from the groups (a) to (d) listed below, with the balance being Fe and impurities, and further the Fn1 expressed by the formula (1a) is 160 or less, the Fn2 expressed by the formula (2a) is 20 to 80, the Fn3 expressed by the formula (3a) is 160 or more, and the Fn4 expressed by the formula (4a) is 90 to 170;

$$Fn1=399\times C+26\times Si+123\times Mn+30\times Cr+32\times Mo+19\times V \quad (1a),$$

$$Fn2=(669.3\times \log_e C-1959.6\times \log_e N-6983.3)\times(0.067\times Mo+0.147\times V) \quad (2a),$$

$$Fn3=140\times Cr+125\times Al+235\times V \quad (3a),$$

$$Fn4=511\times C+33\times Mn+56\times Cu+15\times Ni+36\times Cr+5\times Mo+134\times V \quad (4a);$$

wherein each symbol C, Si, Mn, Cr, Mo, V, N, Al, Cu and Ni in the above formulas (1a) to (4a) represents the content by mass percent of the element concerned;

(a) Mo: 0.50% or less, (b) one or more selected from the group consisting of Cu: 0.50% or less and Ni: 0.50% or less, (c) one or more selected from the group consisting of Nb: 0.10% or less, and Zr: 0.10% or less, (d) one or more selected from the group consisting of Pb: 0.50% or less, Ca: 0.010% or less, Bi: 0.30% or less, Te: 0.30% or less, Se: 0.30% or less, and Sb: 0.30% or less.

5. A steel material for cold forging/nitriding having a chemical composition according to claim 4, wherein the microstructure thereof is a ferritic-pearlitic structure, a ferritic-bainitic structure, or a ferritic-pearlitic-bainitic structure, and the area fraction of ferrite is 70% or more, and further the content of V in precipitates determined by extraction residue analysis is 0.10% or less.

6. A cold-forged/nitrided component having a chemical composition according to claim 4, wherein a core hardness thereof is 220 or more in Vickers hardness, a surface hardness thereof is 650 or more in Vickers hardness, and an effective case depth thereof is 0.20 mm or more.

* * * * *